US011725448B2

(12) United States Patent
Choi

(10) Patent No.: US 11,725,448 B2
(45) Date of Patent: Aug. 15, 2023

(54) VEHICLE DOOR OPENING AND CLOSING APPARATUS

(71) Applicants: Hyundai Motor Company, Seoul (KR); Kia Motors Corporation, Seoul (KR)

(72) Inventor: Je Won Choi, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 302 days.

(21) Appl. No.: 17/009,173

(22) Filed: Sep. 1, 2020

(65) Prior Publication Data

US 2021/0172235 A1 Jun. 10, 2021

(30) Foreign Application Priority Data

Dec. 5, 2019 (KR) ..... 10-2019-0160947

(51) Int. Cl.
*E05D 15/10* (2006.01)
*E05F 15/638* (2015.01)
(Continued)

(52) U.S. Cl.
CPC ..... *E05F 15/638* (2015.01); *E05F 15/619* (2015.01); *E05F 15/655* (2015.01); *E05Y 2201/22* (2013.01); *E05Y 2201/224* (2013.01); *E05Y 2201/41* (2013.01); *E05Y 2201/422* (2013.01); *E05Y 2201/626* (2013.01); *E05Y 2201/684* (2013.01); *E05Y 2201/688* (2013.01); *E05Y 2201/716* (2013.01);
(Continued)

(58) Field of Classification Search
CPC ..... E05F 15/638; E05F 15/619; E05F 15/655; E05Y 2201/22; E05Y 2201/224; E05Y 2201/41; E05Y 2201/422; E05Y 2201/626; E05Y 2201/684; E05Y 2201/688; E05Y 2201/716; E05Y 2201/722; E05Y 2800/102; E05Y 2900/531; E05B 81/16
USPC ..... 49/254, 257, 258, 259, 360
See application file for complete search history.

(56) References Cited

U.S. PATENT DOCUMENTS 5,979,971 A * 11/1999 Mizuki ..... B60L 50/66 49/213
8,567,126 B2 * 10/2013 Hozumi ..... B60J 5/06 49/143
(Continued)

FOREIGN PATENT DOCUMENTS

CN 105984310 A * 10/2016 ..... B60J 5/047
CN 105984311 A * 10/2016 ..... B60J 5/047
(Continued)

*Primary Examiner* — Jerry E Redman
(74) *Attorney, Agent, or Firm* — Slater Matsil, LLP

(57) ABSTRACT

A vehicle door opening and closing apparatus includes a rail configured to be mounted on a vehicle body, a roller unit configured to be mounted on a vehicle door, move along the rail, and allow the vehicle door to open and close in a sliding mode and a swing mode, a center rail configured to extend from a rear edge of a door aperture of the vehicle body, a center roller unit configured to be guided along the center rail, and a flap mechanism configured to prevent the center roller unit from being separated from the center rail in the sliding mode, and to allow the center roller unit to be released from the center rail in the swing mode.

20 Claims, 37 Drawing Sheets

(51) Int. Cl.
*E05F 15/655* (2015.01)
*E05F 15/619* (2015.01)

(52) U.S. Cl.
CPC ... *E05Y 2201/722* (2013.01); *E05Y 2800/102* (2013.01); *E05Y 2900/531* (2013.01)

(56) References Cited

U.S. PATENT DOCUMENTS 8,925,248 B2 * 1/2015 Maruyama ..... B60J 5/047 49/164
9,074,398 B2 * 7/2015 Maruyama ..... E05D 15/48
9,718,331 B2 * 8/2017 Maruyama ..... E05B 83/40
9,731,583 B2 * 8/2017 Maruyama ..... B60J 5/047
9,822,579 B2 * 11/2017 Maruyama ..... E06B 3/509
2013/0227887 A1 * 9/2013 Ojima ..... B60J 5/047 49/143
2014/0026487 A1 * 1/2014 Maruyama ..... B60J 5/06 49/176
2014/0046551 A1 * 2/2014 Ojima ..... B60J 5/047 701/49
2016/0114659 A1 * 4/2016 Maruyama ..... E06B 3/509 49/164
2016/0340938 A1 * 11/2016 Chiba ..... E05B 77/22
2020/0095819 A1 * 3/2020 Cappelli ..... E05F 15/63
2020/0399944 A1 * 12/2020 Morioka ..... E05F 15/646
2021/0140215 A1 5/2021 Choi
2021/0170839 A1 * 6/2021 Choi ..... E05D 15/0604
2021/0172228 A1 * 6/2021 Choi ..... E05D 15/48
2021/0172236 A1 * 6/2021 Choi ..... E05F 15/619
2021/0172237 A1 * 6/2021 Choi ..... E05F 15/655
2022/0090421 A1 * 3/2022 Choi ..... B60J 5/047
2022/0243502 A1 * 8/2022 Itonaga ..... E05B 81/32

FOREIGN PATENT DOCUMENTS

CN 105984312 A * 10/2016 ..... B60J 5/047
CN 115003530 A * 9/2022 ..... E05D 15/0665
DE 102020110154 A1 * 6/2021 ..... B60J 5/06
DE 102020211179 A1 * 6/2021 ..... E05F 15/619
DE 102021113149 A1 * 3/2022 ..... B60J 5/047
EP 1788177 A1 * 5/2007 ..... B60J 5/06
FR 2893543 A1 * 5/2007 ..... B60J 5/06
JP 6992263 B2 * 1/2022 ..... B60J 5/047
KR 20210057616 A 5/2021

* cited by examiner

VEHICLE DOOR OPENING AND CLOSING APPARATUS

CROSS-REFERENCE TO RELATED APPLICATIONS

This application claims the benefit of Korean Patent Application No. 10-2019-0160947, filed on Dec. 5, 2019, in the Korean Intellectual Property Office, which application is hereby incorporated herein by reference.

TECHNICAL FIELD

The present disclosure relates to a vehicle door opening and closing apparatus.

BACKGROUND

Vehicles have door apertures for ingress and egress of vehicle passengers into and out of a passenger compartment in the vehicle. A vehicle door is closed to block the door aperture and is opened to enable ingress and egress of passengers into and out of the passenger compartment through the door aperture. Vehicle doors are divided into swing doors and sliding doors. The swing door is opened and closed by swinging around a hinge mounted between the swing door and the vehicle body. The sliding door is opened and closed by sliding a roller mounted on the sliding door along a rail mounted on the vehicle body.

The swing door is very easy to open and close, thereby enabling quick ingress and egress of passengers. However, when the swing door is opened, a space for ingress and egress is relatively small. When the vehicle is located in a narrow space, a swing trajectory of the door is not secured, which makes the opening and closing operation thereof difficult.

The sliding door is very easy to open and close even when the vehicle is located in a narrow space. When the sliding door is opened, a space for ingress and egress is relatively large. However, the sliding door requires relatively more force and time to open and close, which hinders quick ingress and egress of passengers.

According to the related art, as a vehicle door is operated by a single opening and closing method, it may be difficult to adequately respond to the needs of customers seeking ease of use, diversity, and novelty.

The above information described in this background section is provided to assist in understanding the background of the inventive concept, and may include any technical concept which is not considered as the prior art that is already known to those skilled in the art.

SUMMARY

The present disclosure solves problems occurring in the prior art while advantages achieved by the prior art are maintained intact.

The present disclosure relates to a vehicle door opening and closing apparatus. Particular embodiments relate to a vehicle door opening and closing apparatus that allows a vehicle door to open and close in one mode selected from a swing mode and a sliding mode. Further embodiments relate to a vehicle door opening and closing apparatus capable of preventing a center roller unit from being separated from a center rail in a sliding mode and allowing the center roller unit to be released from the center rail in a swing mode.

An aspect of the present disclosure provides a vehicle door opening and closing apparatus allowing a vehicle door to open and close in one mode selected from a swing mode and a sliding mode, thereby satisfying the needs of customers, and capable of preventing a center roller unit from being separated from a center rail in the sliding mode and allowing the center roller unit to be released from the center rail in the swing mode.

According to an aspect of the present disclosure, a vehicle door opening and closing apparatus may include a vehicle door, a rail mounted on a vehicle body, a roller unit mounted on the vehicle door, moving along the rail, and allowing the vehicle door to open and close in one mode selected from a sliding mode and a swing mode, a center rail extending from a rear edge of a door aperture of the vehicle body, a center roller unit guided along the center rail, and a flap mechanism preventing the center roller unit from being separated from the center rail in the sliding mode, and allowing the center roller unit to be released from the center rail in the swing mode.

The flap mechanism may include a flap which is rotatably mounted on the center rail, and a locking lever which releasably engages with the flap.

The locking lever may move between an engaging position, in which the locking lever engages with the flap, and a release position, in which the locking lever releases the flap.

The locking lever may be movable to the release position by a release lever.

The release lever may move between a lock position, in which the release lever holds the locking lever in the engaging position, and an unlock position, in which the release lever moves the locking lever to the release position.

The flap may include a first flap portion and a second flap portion which is orthogonal to the first flap portion, and the first flap portion may have a first free end releasably engaging with the locking lever.

The flap may further include a first extension portion extending from the first flap portion, a second extension portion extending from the second flap portion, a first projection protruding from an end of the first extension portion, and a second projection protruding from an end of the second extension portion.

The flap mechanism may further include a stopper having a recess in which one of the first projection and the second projection is releasably received.

The stopper may be mounted on the center rail.

The locking lever may include a locking recess which receives at least a portion of the flap and a release shoulder which is located below the locking recess, and the release lever may have a tip pressing the release shoulder.

The flap mechanism may include a flap which is rotatably mounted on the center rail, and a driving motor which rotates the flap.

The flap mechanism may include a flap which is linearly movable on the center rail, and a driving motor which drives the flap.

The flap may include a first flap portion and a second flap portion which is pivotally connected to the first flap portion, and the first flap portion may be rotatable by the driving motor.

The flap may include a flap portion and a guide which is connected to the flap portion, and the guide may be linearly movable by the driving motor.

The guide may have rack teeth, and a pinion meshing with the rack teeth may be connected to the driving motor.

BRIEF DESCRIPTION OF THE DRAWINGS

The above and other objects, features and advantages of embodiments of the present disclosure will be more apparent from the following detailed description taken in conjunction with the accompanying drawings, in which.

DETAILED DESCRIPTION OF ILLUSTRATIVE EMBODIMENTS

Figure 1:
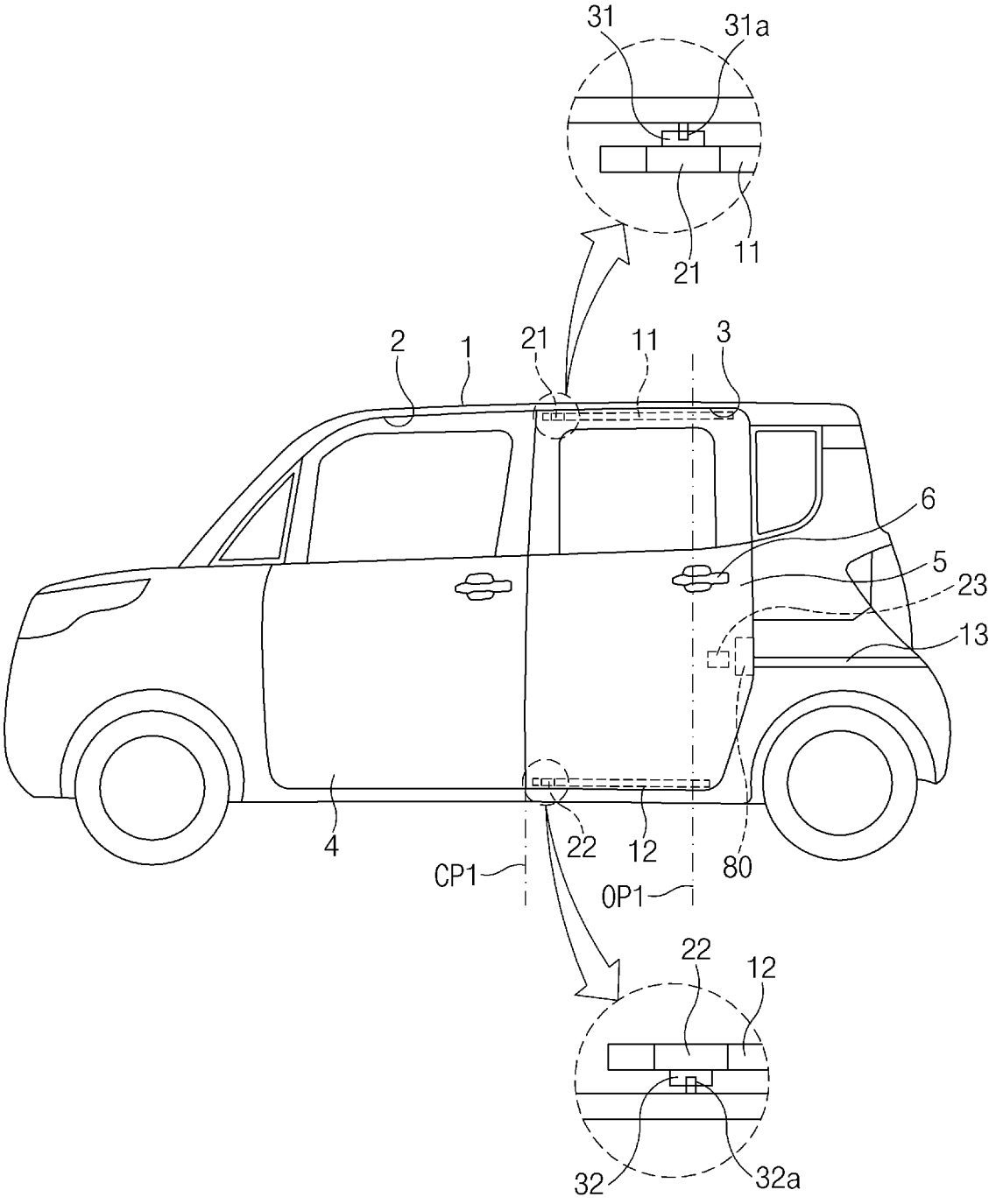
FIG. 1 illustrates a vehicle door opening and closing apparatus according to an exemplary embodiment of the present disclosure, which is mounted on a rear door of a vehicle.

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be omitted in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

A vehicle door opening and closing apparatus, according to exemplary embodiments of the present disclosure, may allow a vehicle door to open and close selectively in any one mode of a sliding mode and a swing mode. In other words, the vehicle door opening and closing apparatus, according to exemplary embodiments of the present disclosure, may be a transform-type door opening and closing apparatus. The sliding mode may allow the vehicle door to open and close by sliding in a longitudinal direction of a vehicle, and the swing mode may allow the vehicle door to open and close by swinging inwards and outwards.

Referring to FIG. 1, a vehicle body 1 may have a plurality of door apertures 2 and 3, and the plurality of door apertures 2 and 3 may be divided into a front aperture 2 and a rear aperture 3. A plurality of vehicle doors 4 and 5 may include a front door 4 covering and uncovering the front aperture 2, and a rear door 5 covering and uncovering the rear aperture 3. As the front door 4 is opened, the front door 4 may uncover the front aperture 2, and as the front door 4 is closed, the front door 4 may cover the front aperture 2. As the rear door 5 is opened, the rear door 5 may uncover the rear aperture 3, and as the rear door 5 is closed, the rear door 5 may cover the rear aperture 3.

The vehicle door opening and closing apparatus, according to exemplary embodiments of the present disclosure, may be applied to the front door 4, the rear door 5, and the like. FIGS. 1 to 16 illustrate a vehicle door opening and closing apparatus according to exemplary embodiments of the present disclosure, which is applied to the rear door 5. Hereinafter, the rear door 5 will be referred to as the vehicle door 5, and the rear aperture 3 will be referred to as the door aperture 3.

The vehicle door opening and closing apparatus, according to exemplary embodiments of the present disclosure, may include one or more rails 11 and 12 mounted on the vehicle body 1, and the rails 11 and 12 may extend in the longitudinal direction of the vehicle. Referring to FIG. 1, an upper rail 11 may be mounted on an upper edge of the vehicle body 1, and a lower rail 12 may be mounted on a lower edge of the vehicle body 1. The upper rail 11 and the lower rail 12 may extend in the longitudinal direction of the vehicle. The upper rail 11 may be disposed on an upper edge of the door aperture 3, and the lower rail 12 may be disposed on a lower edge of the door aperture 3.

The vehicle door opening and closing apparatus, according to exemplary embodiments of the present disclosure, may include roller units 21 and 22 guided along the rails 11 and 12. The roller units 21 and 22 may allow the vehicle door 5 to open and close in one mode selected from the sliding mode and the swing mode. In particular, the roller units 21 and 22 may be releasably held in predetermined positions of the rails 11 and 12 by hold locks 31 and 32. Specifically, when the roller units 21 and 22 are held in the predetermined positions of the rails 11 and 12 by the hold locks 31 and 32, the vehicle door 5 may be opened and closed in the swing mode in which the vehicle door swings in the predetermined positions of the rails 11 and 12. When the roller units 21 and 22 are released by the hold locks 31 and 32, the vehicle door 5 may be opened and closed in the sliding mode in which the vehicle door slides along the rails 11 and 12.

Figure 3:
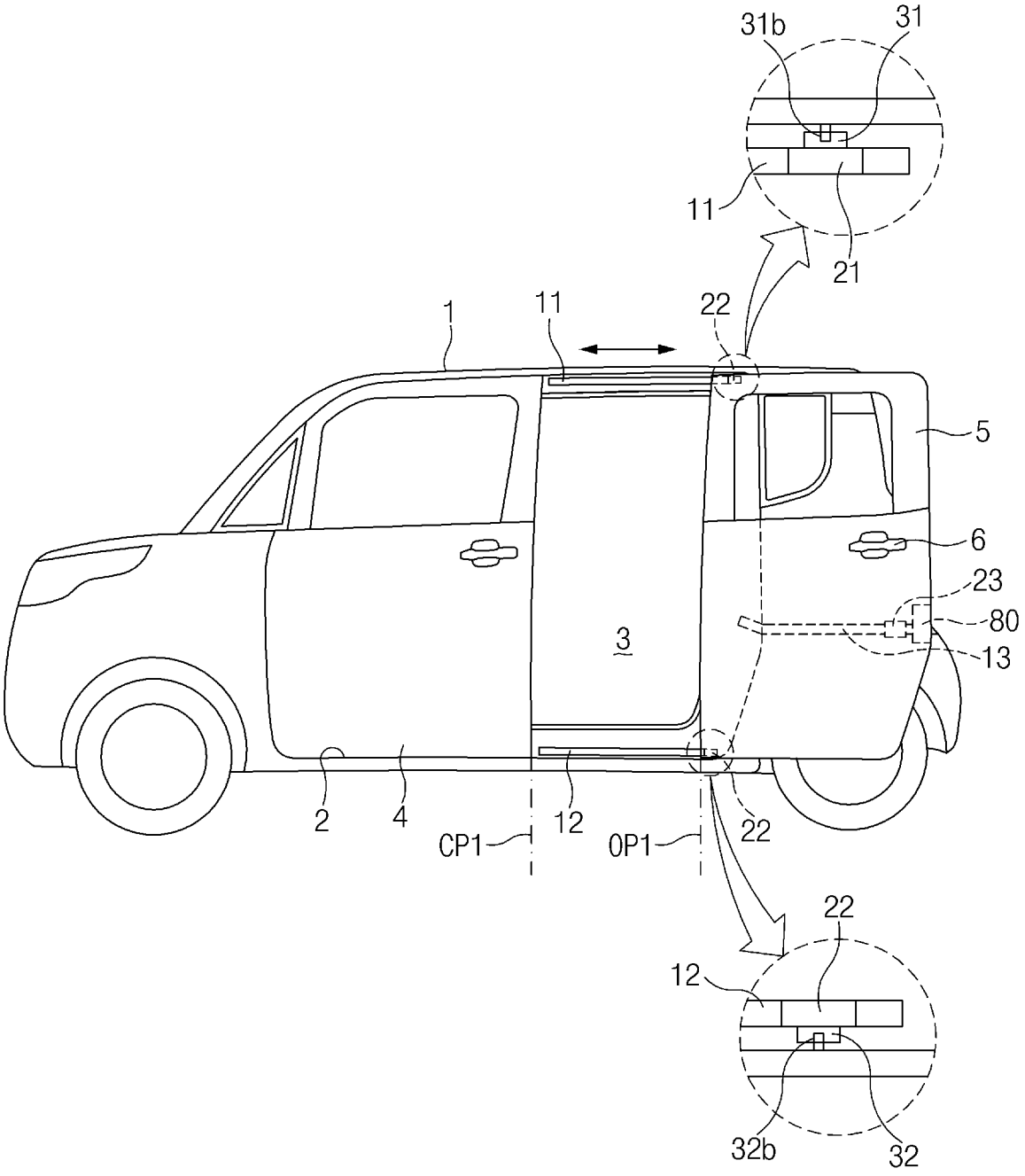
FIG. 3 illustrates a state in which the door of FIG. 1 is opened in a sliding mode.

Referring to FIGS. 1 and 3, an upper roller unit 21 may be mounted on an upper end of the vehicle door 5, and the upper roller unit 21 may slide along the upper rail 11. A lower roller unit 22 may be mounted on a lower end of the vehicle door 5, and the lower roller unit 22 may slide along the lower rail 12.

Figure 2:
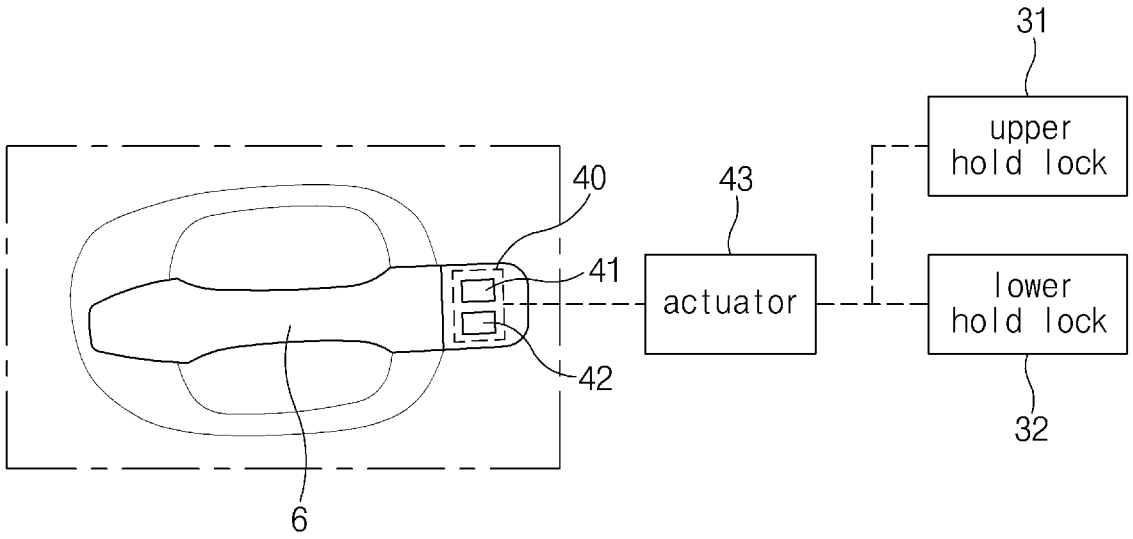
FIG. 2 illustrates a selector adjacent to an outside handle of a vehicle, an actuator connected to the selector, and hold locks.

Referring to FIG. 2, the vehicle door 5 may include an outside handle 6, and a selector 40 for selecting the sliding mode and the swing mode may be adjacent to the outside handle 6. The selector 40 may have a first switch 41 selecting the sliding mode, and a second switch 42 selecting the swing mode.

When a user presses the first switch 41 and the sliding mode is selected, the vehicle door 5 may slide along the upper rail 11, the lower rail 12, and a center rail 13 as illustrated in FIG. 3 as the user pushes the outside handle 6 toward the front of the vehicle or pulls the outside handle 6 toward the rear of the vehicle. In the sliding mode, the vehicle door 5 may move between a first open position OP1 and a first closed position CP1, as illustrated in FIGS. 1 and 3. The first open position OP1 refers to a position in which the vehicle door 5 is fully opened, and the first closed position CP1 refers to a position in which the vehicle door 5 is fully closed.

Figure 4:
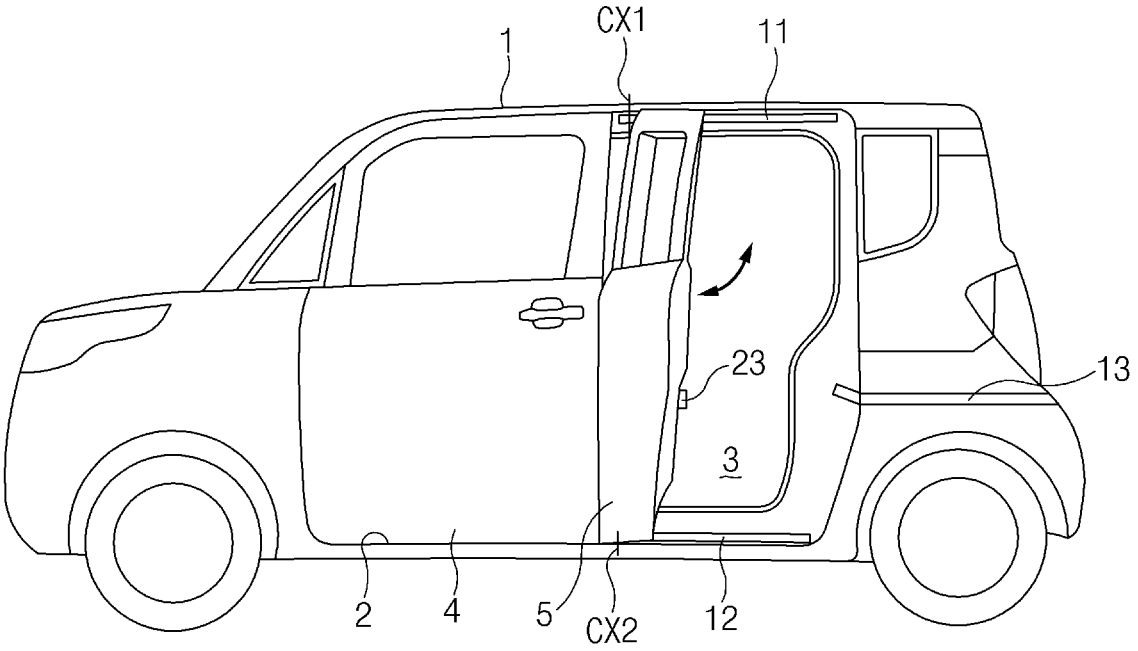
FIG. 4 illustrates a state in which the door of FIG. 1 is opened in a swing mode.
Figure 7:
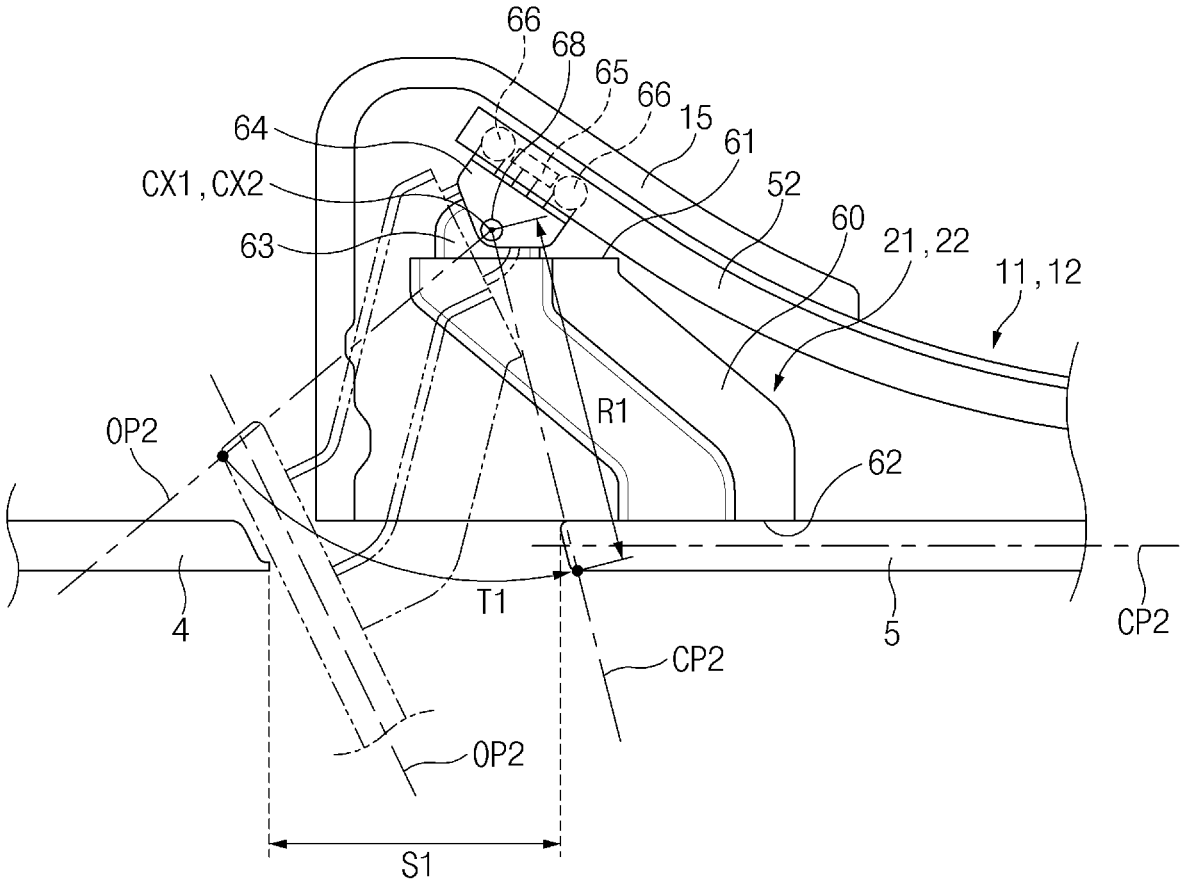
FIG. 7 illustrates an operation in which a vehicle door is opened and closed in a swing mode by an upper roller unit and a lower roller unit of a vehicle door opening and closing apparatus according to an exemplary embodiment of the present disclosure.
Figure 9:
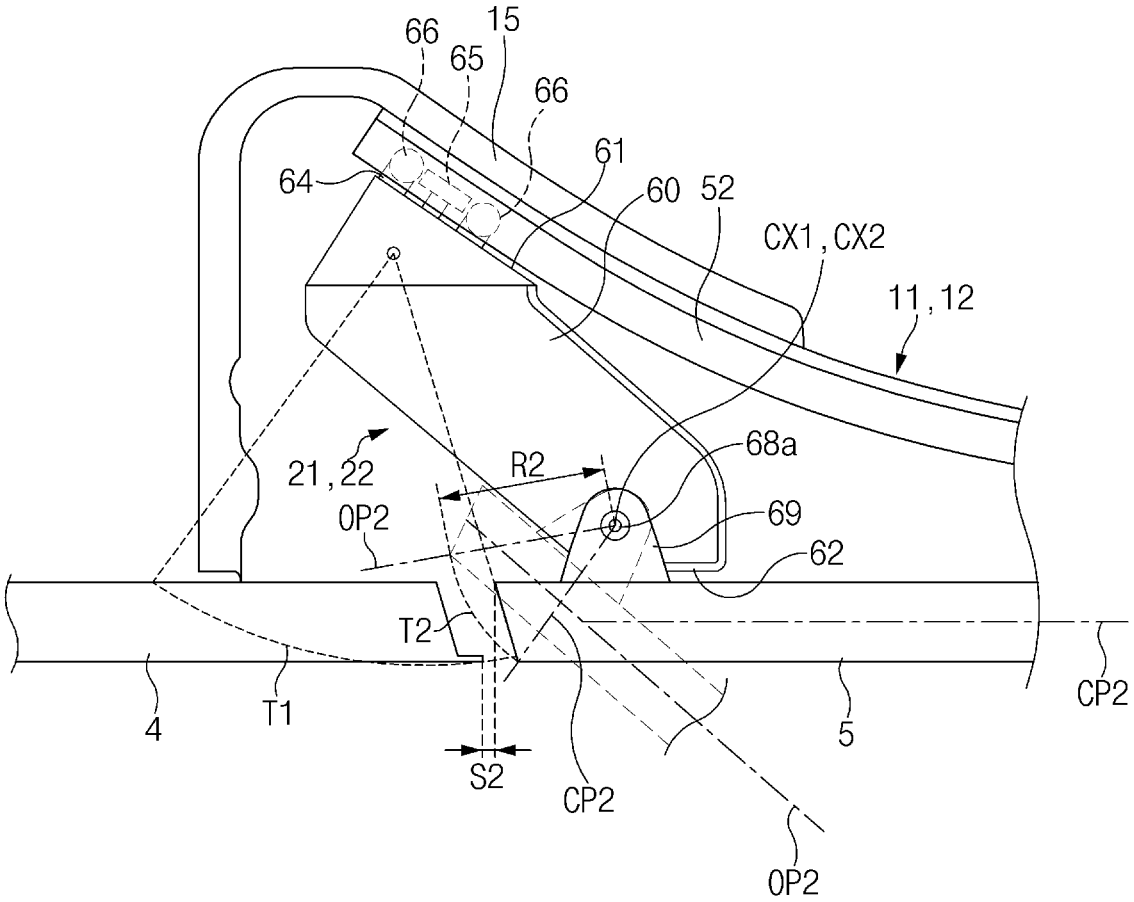
FIG. 9 illustrates an operation in which a vehicle door is opened and closed in a swing mode by an upper roller unit and a lower roller unit of a vehicle door opening and closing apparatus according to another exemplary embodiment of the present disclosure.

When the user presses the second switch 42 and the swing mode is selected, the vehicle door 5 may swing as illustrated in FIG. 4 as the user pushes or pulls the outside handle 6 toward a passenger compartment of the vehicle or toward the exterior side of the vehicle. In the swing mode, the vehicle door 5 may move between a second open position OP2 in which the vehicle door 5 is fully opened and a second closed position CP2 in which the vehicle door 5 is fully closed, as illustrated in FIGS. 7 and 9. In particular, when the vehicle door 5 is held in the first closed position CP1, it may be operated in the swing mode.

The upper roller unit 21 may have an upper hold lock 31, and the vehicle body 1 may have a first upper striker 31*a* and a second upper striker 31*b* protruding downwardly from a roof of the vehicle body 1. The first upper striker 31*a* may be aligned with or adjacent to a virtual axis of the first closed position CP1, and the second upper striker 31*b* may be aligned with or adjacent to a virtual axis of the first open position OP1.

According to an exemplary embodiment, as illustrated in FIGS. 1 and 3, the upper hold lock 31 may releasably hold the first upper striker 31*a* in the first closed position CP1, and releasably hold the second upper striker 31*b* in the first open position OP1. That is, one upper hold lock 31 may selectively hold the first upper striker 31*a* and the second upper striker 31*b*. As the upper hold lock 31 holds the first upper striker 31*a*, the upper roller unit 21 may be firmly held in the first closed position CP1, so that the vehicle door 5 may be kept in the first closed position CP1. As the upper hold lock 31 holds the second upper striker 31*b*, the upper roller unit 21 may be firmly held in the first open position OP1, so that the vehicle door 5 may be kept in the first open position OP1.

According to another exemplary embodiment, the upper hold lock 31 may releasably hold the first upper striker 31*a* in the first closed position CP1 so that the vehicle door 5 may be kept in the first closed position CP1. That is, the upper hold lock 31 may be an upper closed hold lock which keeps the closed state of the vehicle door 5 in the first closed position CP1. An upper open hold lock (not shown) may be mounted on the upper roller unit 21, and may releasably hold the second upper striker 31*b* in the first open position OP1. That is, the upper closed hold lock, which releasably holds the first upper striker 31*a* in the first closed position CP1, and the upper open hold lock, which releasably holds the second upper striker 31*b* in the first open position OP1, may be individually mounted on the upper roller unit 21.

Referring to FIGS. 4 and 9, the upper roller unit 21 may have an upper rotation axis CX1, and the vehicle door 5 may rotate around the upper rotation axis CX1. When the upper roller unit 21 is firmly held in the first closed position CP1 by the upper hold lock 31 and the first upper striker 31*a*, the vehicle door 5 may rotate around the upper rotation axis CX1.

The lower roller unit 22 may have a lower hold lock 32, and the vehicle body 1 may have a first lower striker 32*a* and a second lower striker 32*b* protruding upwardly from the bottom of the vehicle body 1. The first lower striker 32*a* may be aligned with or adjacent to the virtual axis of the first closed position CP1, and the second lower striker 32*b* may be aligned with or adjacent to the virtual axis of the first open position OP1.

According to an exemplary embodiment, as illustrated in FIGS. 1 and 3, the lower hold lock 32 may releasably hold the first lower striker 32*a* in the first closed position CP1, and releasably hold the second lower striker 32*b* in the first open position OP1. That is, one lower hold lock 32 may selectively hold the first lower striker 32*a* and the second lower striker 32*b*. As the lower hold lock 32 holds the first lower striker 32*a*, the lower roller unit 22 may be firmly held in the first closed position CP1, so that the vehicle door 5 may be kept in the first closed position CP1. As the lower hold lock 32 holds the second lower striker 32*b*, the lower roller unit 22 may be firmly held in the first open position OP1, so that the vehicle door 5 may be kept in the first open position OP1.

According to another exemplary embodiment, the lower hold lock 32 may releasably hold the first lower striker 32*a* in the first closed position CP1 so that the vehicle door 5 may be kept in the first closed position CP1. That is, the lower hold lock 32 may be a lower closed hold lock which keeps the closed state of the vehicle door 5 in the first closed position CP1. A lower open hold lock (not shown) may be mounted on the lower roller unit 22, and may releasably hold the second lower striker 32*b* in the first open position OP1. That is, the lower closed hold lock, which releasably holds the first lower striker 32*a* in the first closed position CP1, and the lower open hold lock, which releasably holds the second lower striker 32*b* in the first open position OP1, may be individually mounted on the lower roller unit 22.

According to an exemplary embodiment, the vehicle door 5 may be releasably held in the first closed position CP1 by the upper hold lock 31 and the lower hold lock 32, so that the vehicle door 5 may be kept in the first closed position CP1 by the upper hold lock 31 and the lower hold lock 32. That is, the upper hold lock 31 and the lower hold lock 32 may function as the closed hold lock which holds the vehicle door 5 in the first closed position CP1.

Referring to FIGS. 4 and 9, the lower roller unit 22 may have a lower rotation axis CX2, and the vehicle door 5 may rotate around the lower rotation axis CX2. When the lower roller unit 22 is firmly held in the first closed position CP1 by the lower hold lock 32 and the first lower striker 32*a*, the vehicle door 5 may rotate around the lower rotation axis CX2.

As illustrated in FIG. 4, the upper rotation axis CX1 and the lower rotation axis CX2 may be vertically aligned, and the vehicle door 5 may rotate around the vertically aligned upper and lower rotation axes CX1 and CX2.

Referring to FIG. 2, the selector 40 may be electrically connected to an actuator 43, and the actuator 43 may be configured to operate the upper hold lock 31 and the lower hold lock 32.

As the user selects the selector 40, the actuator 43 may selectively perform a hold operation in which the upper hold lock 31 holds the first upper striker 31*a* and the lower hold lock 32 holds the first lower striker 32*a*, and a release operation in which the upper hold lock 31 releases the first upper striker 31*a* and the lower hold lock 32 releases the first lower striker 32*a*.

When the user presses the first switch 41 of the selector 40 in a state in which the vehicle door 5 is closed, the upper hold lock 31 may release the first upper striker 31*a* and the lower hold lock 32 may release the first lower striker 32*a* simultaneously by the release operation of the actuator 43. Thus, the user may slide the vehicle door 5 in the longitudinal direction of the vehicle body 1 so that the vehicle door 5 may be opened and closed in the sliding mode.

When the user presses the second switch 42 of the selector 40 in a state in which the vehicle door 5 is closed, the upper hold lock 31 may hold the first upper striker 31*a* and the lower hold lock 32 may hold the first lower striker 32*a* simultaneously by the hold operation of the actuator 43, and the upper roller unit 21 and the lower roller unit 22 may be firmly held in the first closed position CP1. Thus, the user may swing the vehicle door 5 toward an interior space and an exterior space of the vehicle so that the vehicle door 5 may be opened and closed in the swing mode.

According to an exemplary embodiment, as illustrated in FIG. 2, one actuator 43 may operate the upper hold lock 31 and the lower hold lock 32 simultaneously.

According to another exemplary embodiment, an actuator operating the upper hold lock 31 and another actuator operating the lower hold lock 32 may be individually connected to the selector 40.

FIGS. 10A to 10D illustrate the upper hold lock 31 and the lower hold lock 32 according to an exemplary embodiment of the present disclosure. Referring to FIGS. 10A to 10D, each of the upper hold lock 31 and the lower hold lock 32 may include a catch 71, a pawl 72 releasably engaging with the catch 71, and a lever 73 operatively connected to the pawl 72. The lever 73 may be connected to the actuator 43 through a cable 75. As the cable 75 is reversed (pulled) by the actuator 43, the catch 71 may release the strikers 31*a* and 32*a*. A portion of the catch 71, the pawl 72, and the lever 73 may be covered by a cover plate 76, and the cover plate 76 may be attached to a mounting plate 74. The strikers 31*a* and 32*a* may be fixed to the vehicle body 1 by a mounting plate 78.

Referring to FIGS. 10A to 10D, the upper hold lock 31 may releasably hold the first upper striker 31*a*, and the lower hold lock 32 may releasably hold the first lower striker 32*a*.

Figure 10A:
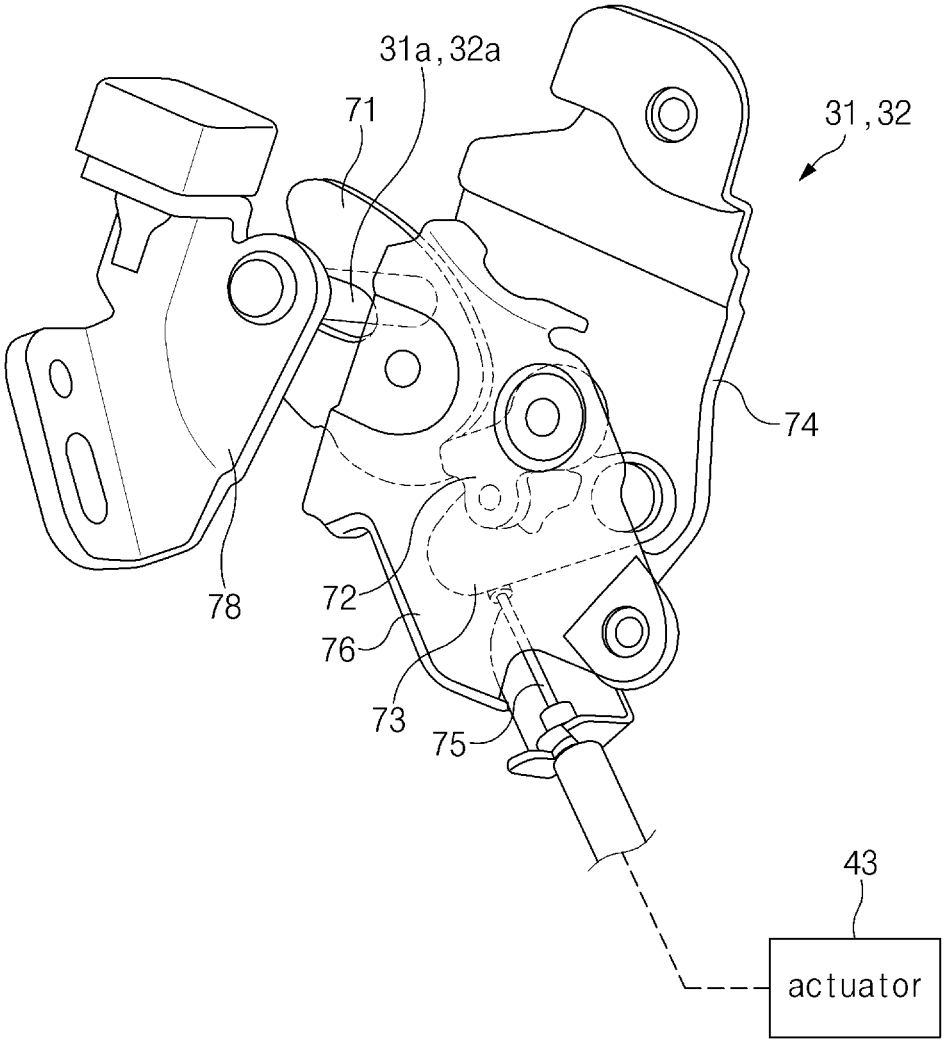
FIG. 10A illustrates a perspective view of an upper hold lock and a lower hold lock.
Figure 10B:
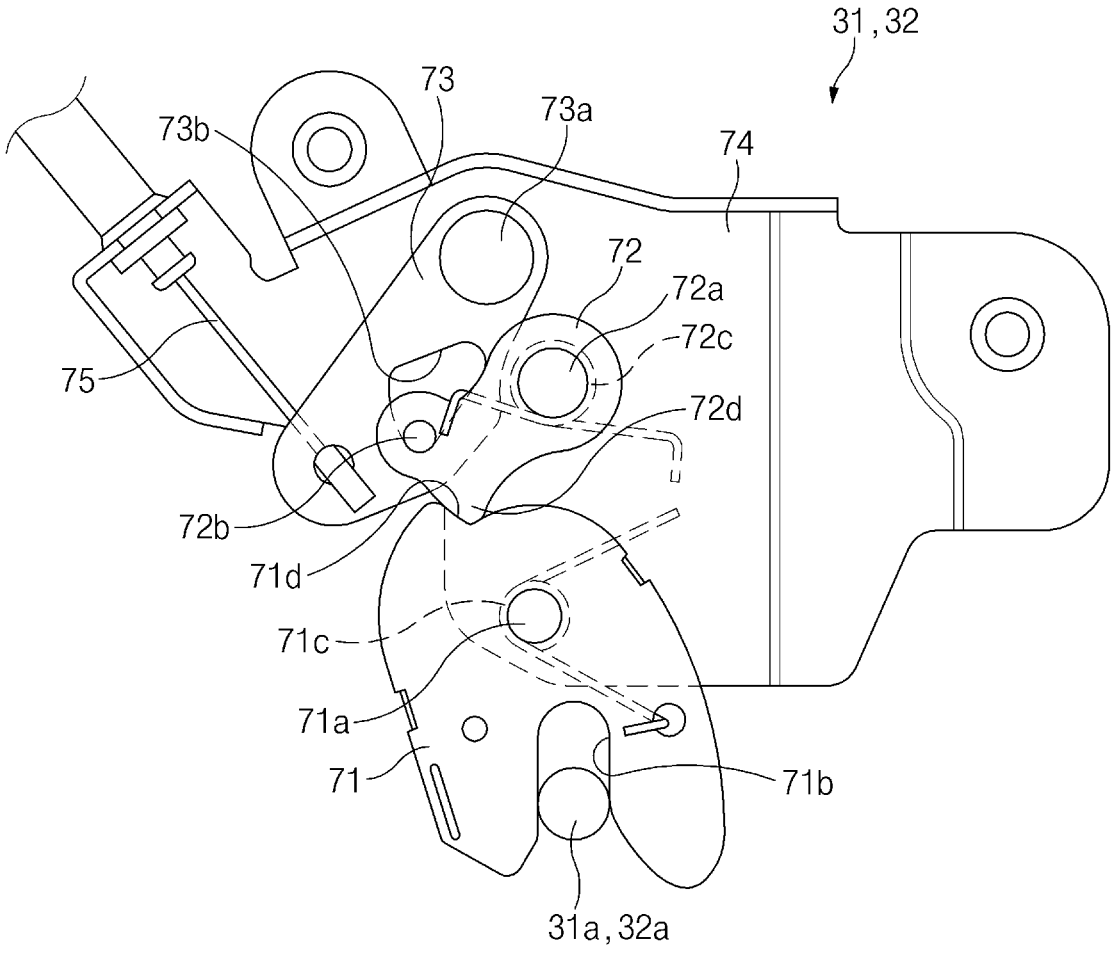
FIG. 10B illustrates a state in which an upper hold lock and a lower hold lock hold corresponding strikers.
Figure 10C:
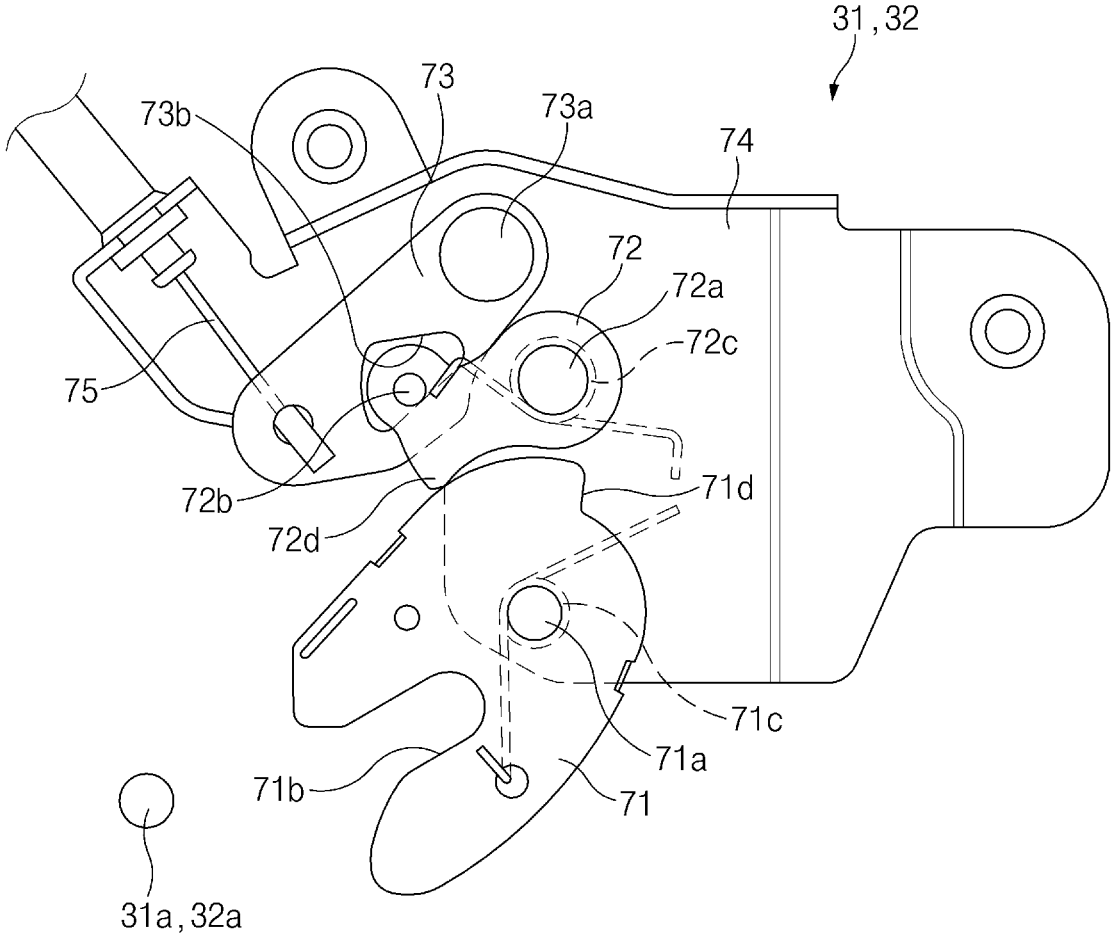
FIG. 10C illustrates a state in which an upper hold lock and a lower hold lock release corresponding strikers.

The catch 71 may be pivotally mounted on the mounting plate 74 through a first pivot shaft 71*a*. The catch 71 may have a slot 71*b* receiving the strikers 31*a* and 32*a*, and the catch 71 may engage with or release the strikers 31*a* and 32*a*. The catch 71 may move between an engaging position (see FIG. 10B) and a release position (see FIG. 10C). The engaging position refers to a position in which the catch 71 engages with the strikers 31*a* and 32*a* as illustrated in FIG. 10B, and the release position refers to a position in which the catch 71 releases the strikers 31*a* and 32*a* as illustrated in FIG. 10C. When the catch 71 is in the engaging position as illustrated in FIG. 10B, the catch 71 may engage with the strikers 31*a* and 32*a* so that the catch 71 may hold the strikers 31*a* and 32*a*. When the catch 71 is in the release position as illustrated in FIG. 10C, the catch 71 may release the strikers 31*a* and 32*a*. Thus, the strikers 31*a* and 32*a* may be released from the slot 71*b* of the catch 71 or be received in the slot 71*b* of the catch 71. The catch 71 may be biased toward the release position by a first biasing element 71*c* such as a torsion spring. The first biasing element 71*c* may be disposed around the first pivot shaft 71*a*. The catch 71 may have a locking shoulder 71*d*.

Figure 10D:
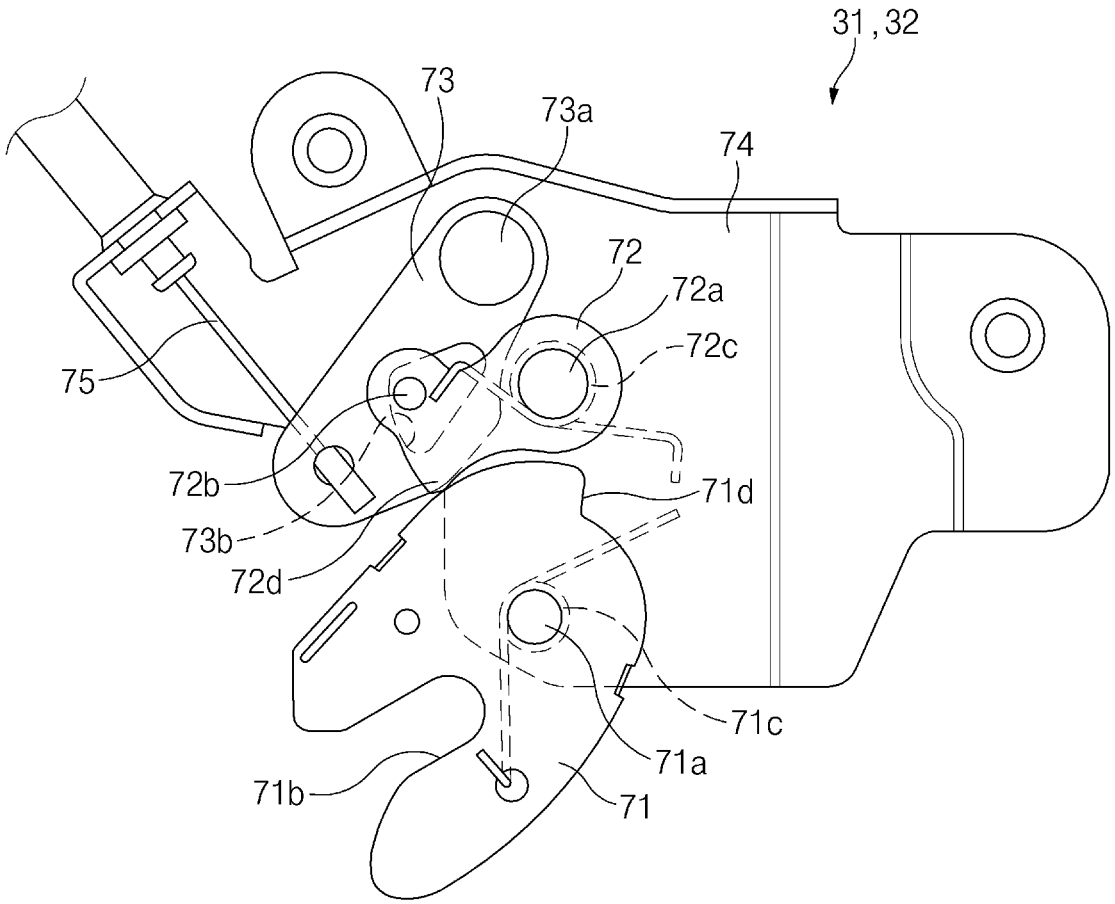
FIG. 10D illustrates a state in which an upper hold lock and a lower hold lock are enabled to receive corresponding strikers.

The pawl 72 may be pivotally mounted on the mounting plate 74 through a second pivot shaft 72*a*, and the pawl 72 may move between a pawl locking position (see FIG. 10B) and a pawl release position (see FIGS. 10C and 10D). The pawl locking position refers to a position in which the pawl 72 engages with the catch 71 and the catch 71 is kept in the engaging position, and the pawl release position refers to a position in which the pawl 72 releases the catch 71 and the catch 71 is allowed to move from the engaging position to the release position. As illustrated in FIG. 10B, when the pawl 72 is in the pawl locking position, the movement (rotation) of the catch 71 may be restricted by the pawl 72 so that the catch 71 may be kept in the engaging position. As illustrated in FIGS. 10C and 10D, when the pawl 72 is in the pawl release position, the movement (rotation) of the catch 71 may not be restricted by the pawl 72 so that the catch 71 may move from the engaging position to the release position. The pawl 72 may be biased toward the pawl locking position (see FIG. 10B) by a second biasing element 72*c* such as a torsion spring. The second biasing element 72*c* may be disposed around the second pivot shaft 72*a*.

The pawl 72 may have a locking projection 72*d* locked to the locking shoulder 71*d* of the catch 71. As illustrated in FIG. 10B, as the pawl 72 is moved to the pawl locking position by the second biasing element 72*c*, the locking projection 72*d* of the pawl 72 may be locked to the locking shoulder 71*d* of the catch 71 and the movement (rotation) of the catch 71 may be restricted, so that the catch 71 may be kept in the engaging position. As illustrated in FIG. 10C, as the pawl 72 is moved to the pawl release position by the lever 73, the locking projection 72*d* of the pawl 72 may be released from the locking shoulder 71*d* of the catch 71 and the movement (rotation) of the catch 71 may be allowed, so that the catch 71 may be moved to the release position by the first biasing element 71*c*.

The lever 73 may be pivotally mounted on the mounting plate 74 through a third pivot shaft 73*a*. The lever 73 may be connected to the actuator 43 through the cable 75. An end of the cable 75 may be fixed to the lever 73, and the cable 75 may be advanced or reversed by the actuator 43. As the actuator 43 moves the cable 75, the lever 73 may pivot around the third pivot shaft 73*a*. The lever 73 may move the pawl 72 to the pawl release position (see FIG. 10C) by reversing the cable 75.

The lever 73 may be operatively connected to the pawl 72 through a pin 72*b* and an opening 73*b*. The pin 72*b* may be provided on the pawl 72, and the opening 73*b* may be provided in the lever 73. The pin 72*b* may be movably received in the opening 73*b*. As the lever 73 pivots around the third pivot shaft 73*a*, the pin 72*b* may move in the opening 73*b*, allowing the pawl 72 to move.

As illustrated in FIG. 10B, when the cable 75 is advanced by the actuator 43, the locking projection 72*d* of the pawl 72 may be locked to the locking shoulder 71*d* of the catch 71 and the movement (rotation) of the catch 71 may be restricted so that the catch 71 may be kept in the engaging position. The strikers 31*a* and 32*a* may be held in the slot 71*b* of the catch 71. That is, the upper hold lock 31 and the lower hold lock 32 may hold the corresponding strikers 31*a* and 32*a*.

As illustrated in FIG. 10C, when the cable 75 is reversed by the actuator 43, the lever 73 may move the pawl 72 to the pawl release position. The locking projection 72*d* of the pawl 72 may be released from the locking shoulder 71*d* of the catch 71 and the movement (rotation) of the catch 71 may be allowed, so that the catch 71 may be moved to the release position by the first biasing element 71*c*, and the strikers 31*a* and 32*a* may be released from the slot 71*b* of the catch 71. Thus, the upper hold lock 31 and the lower hold lock 32 may release the corresponding strikers 31*a* and 32*a*, and the upper roller unit 21 and the lower roller unit 22 may slide along the upper rail 11 and the lower rail 12.

As illustrated in FIG. 10D, even though the cable 75 is advanced by the actuator 43 in a state in which the locking projection 72*d* of the pawl 72 is released from the locking shoulder 71*d* of the catch 71, the catch 71 may be kept in the release position by the first biasing element 71*c* so that the movement (rotation) of the catch 71 may be allowed. In this state, the strikers 31*a* and 32*a* may be allowed to be received in the slot 71*b* of the catch 71. That is, in a state in which the movement (rotation) of the catch 71 is allowed as the locking projection 72*d* of the pawl 72 is released from the locking shoulder 71*d* of the catch 71, when the upper roller unit 21 and the lower roller unit 22 slide between the first closed position CP1 and the first open position OP1, the strikers 31*a* and 32*a* may be allowed to be received in the slot 71*b* of the catch 71. When a force applied by the upper hold lock 31 and the lower hold lock 32 in a state in which the strikers 31*a* and 32*a* are received in the slot 71*b* of the catch 71 is greater than a spring force of the first biasing element 71*c*, the catch 71 may be moved to the engaging position. As illustrated in FIG. 10B, as the locking projection 72*d* of the pawl 72 is locked to the locking shoulder 71*d* of the catch 71, the catch 71 may hold the strikers 31*a* and 32*a*.

Figure 5:
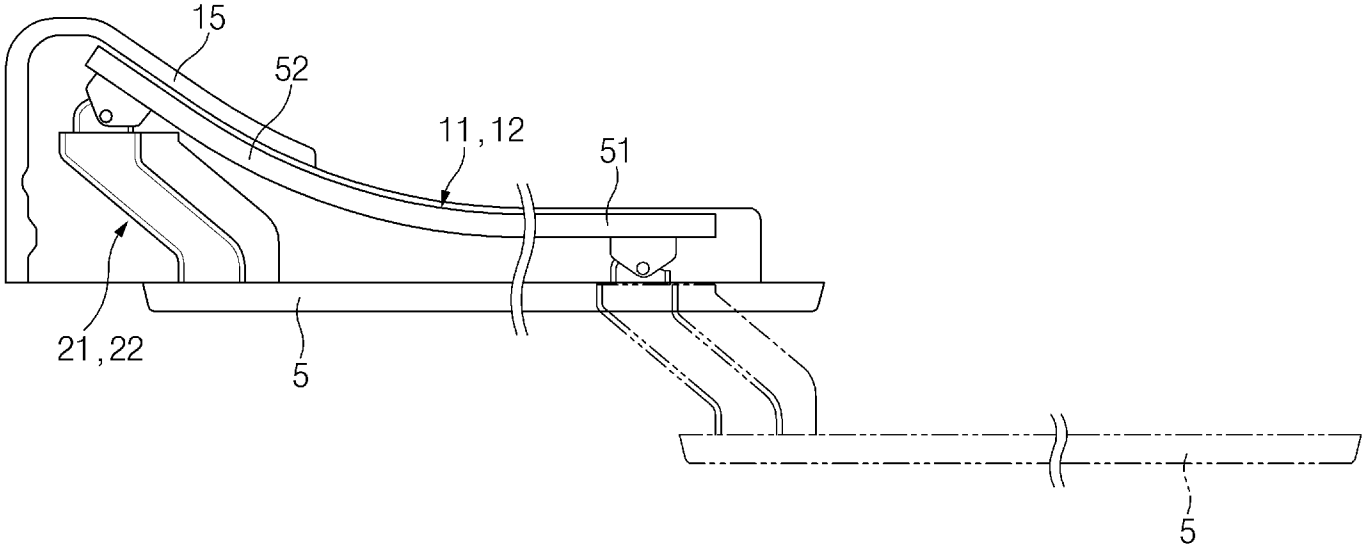
FIG. 5 illustrates an operation in which an upper roller unit and a lower roller unit move along an upper rail and a lower rail in a vehicle door opening and closing apparatus according to an exemplary embodiment of the present disclosure.

Referring to FIG. 5, each of the upper rail 11 and the lower rail 12 may be mounted on the vehicle body 1 through a mounting bracket 15, and the mounting bracket 15 may have a shape corresponding to that of the upper rail 11 and the lower rail 12. Each of the upper rail 11 and the lower rail 12 may have a first extension portion 51 extending straightly in the longitudinal direction of the vehicle, and a second extension portion 52 extending from the first extension portion 51 toward the interior space of the vehicle. The second extension portion 52 may be bent with respect to the first extension portion 51 at a predetermined angle.

Figure 6:
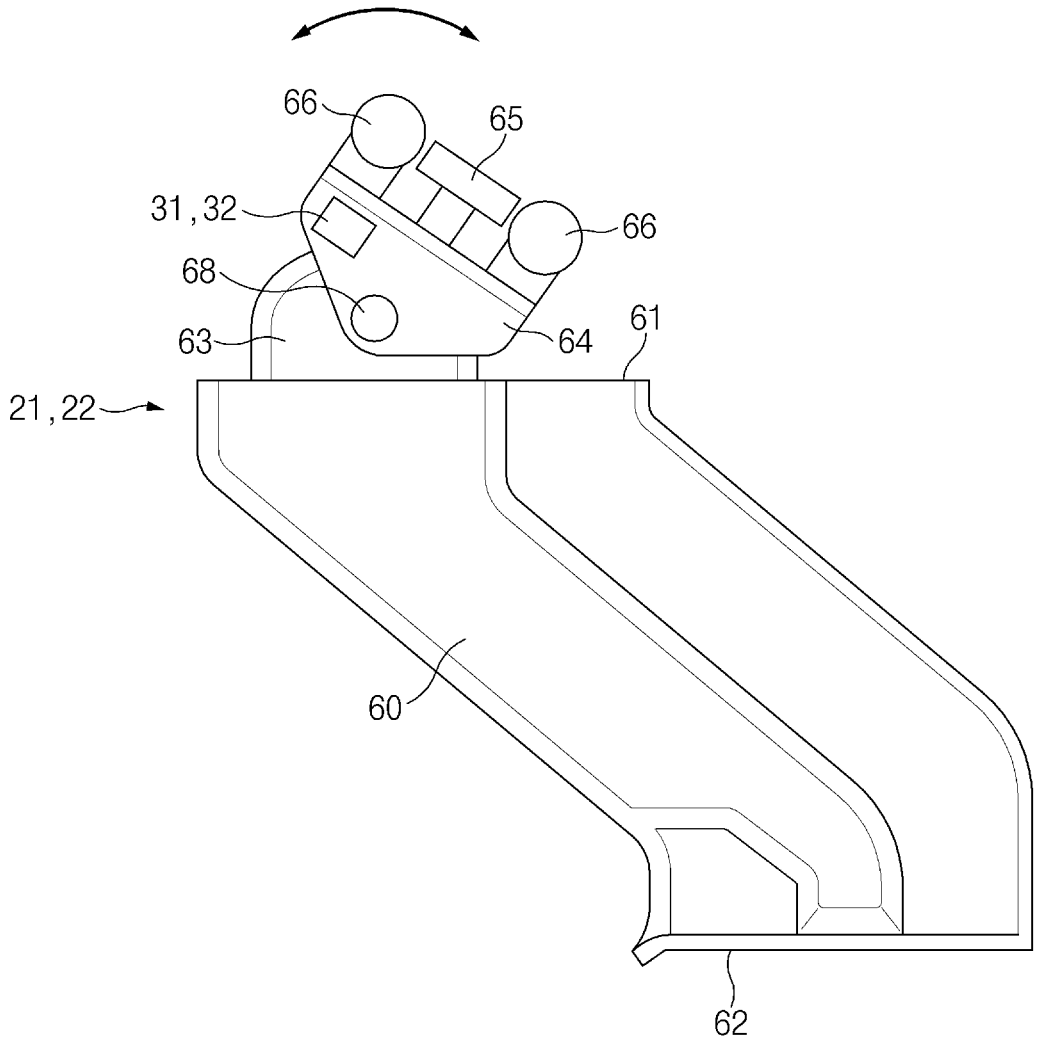
FIG. 6 illustrates an upper roller unit and a lower roller unit in a vehicle door opening and closing apparatus according to an exemplary embodiment of the present disclosure.

Referring to FIG. 6, each of the upper roller unit 21 and the lower roller unit 22 may include a roller bracket 64 having rollers 65 and 66 rolling along the rails 11 and 12, and a body 60 connecting the roller bracket 64 and the vehicle door 5.

The body 60 may extend diagonally so as not to contact the first extension portion 51 and the second extension portion 52. The body 60 may have a first end portion 61 facing the interior side of the vehicle, and a second end portion 62 facing the exterior side of the vehicle. The first end portion 61 of the body 60 may be attached to the roller bracket 64, and the second end portion 62 of the body 60 may be attached to the vehicle door 5.

The roller bracket 64 may rotatably support the rollers 65 and 66, and the rollers 65 and 66 may roll along the upper rail 11 and the lower rail 12. As illustrated in FIG. 6, a middle roller 65 and two side rollers 66 disposed on both sides of the middle roller 65 may be rotatably mounted on the roller bracket 64. A rotation axis of the middle roller 65 may be orthogonal to a rotation axis of the side roller 66.

According to an exemplary embodiment, as illustrated in FIG. 6, the first end portion 61 of the body 60 may be pivotally connected to the roller bracket 64 through a pivot pin 68, and the second end portion 62 of the body 60 may be fixed to the vehicle door 5. Thus, the vehicle door 5 may swing around the pivot pin 68 adjacent to the roller bracket 64. The body 60 may have a pivot lug 63 protruding from the first end portion 61 toward the roller bracket 64, and the roller bracket 64 may be connected to the pivot lug 63 through the pivot pin 68. The roller bracket 64 may be shaped so as not to interfere with the body 60 when the vehicle door 5 swings. The upper rotation axis CX1 and the lower rotation axis CX2 may be defined by the pivot pin 68. For example, the upper rotation axis CX1 and the lower rotation axis CX2 may be a virtual axis extending vertically along a center point of the pivot pin 68, and the upper rotation axis CX1 and the lower rotation axis CX2 may be vertically aligned, so that the vehicle door 5 may swing around the vertical rotation axis that virtually connects the upper rotation axis CX1 and the lower rotation axis CX2. The upper hold lock 31 may be fixed to the roller bracket 64 of the upper roller unit 21, and the lower hold lock 32 may be fixed to the roller bracket 64 of the lower roller unit 22.

When, by the hold operation of the actuator 43, the upper hold lock 31 firmly holds the roller bracket 64 of the upper roller unit 21 in the first closed position CP1 and the lower hold lock 32 firmly holds the roller bracket 64 of the lower roller unit 22 in the first closed position CP1, the vehicle door 5 may swing around the upper rotation axis CX1 of the upper roller unit 21 and the lower rotation axis CX2 of the lower roller unit 22 as illustrated in FIG. 7. The vehicle door 5 may move between the second closed position CP2 in which the vehicle door 5 is closed and the second open position OP2 in which the vehicle door 5 is opened. When the vehicle door 5 swings, another adjacent door 4 or other components may be spaced apart from the vehicle door 5 by a predetermined gap S1 so as not to interfere with the adjacent door 4 or the other components. For example, the vehicle door 5 may be a rear door, and another adjacent door 4 may be a front door.

According to the exemplary embodiment illustrated in FIGS. 6 and 7, as the pivot pin 68 is located between the roller bracket 64 and the first end portion 61 of the body 60, the rotation axes CX1 and CX2 of the vehicle door 5 may be relatively far from the vehicle door 5. Since a swing trajectory T1 and a rotation radius R1 of the vehicle door 5 are relatively increased, the gap S1 between the vehicle door 5 and the adjacent door 4 may be relatively increased. If the gap S1 between the vehicle door 5 and the adjacent door 4 is reduced, the vehicle door 5 may interfere with the adjacent door 4 when the vehicle door 5 moves toward the second open position OP2, and an open space created by the swing of the vehicle door 5 may be relatively narrowed since the swing trajectory T1 of the vehicle door 5 is relatively reduced.

Figure 8:
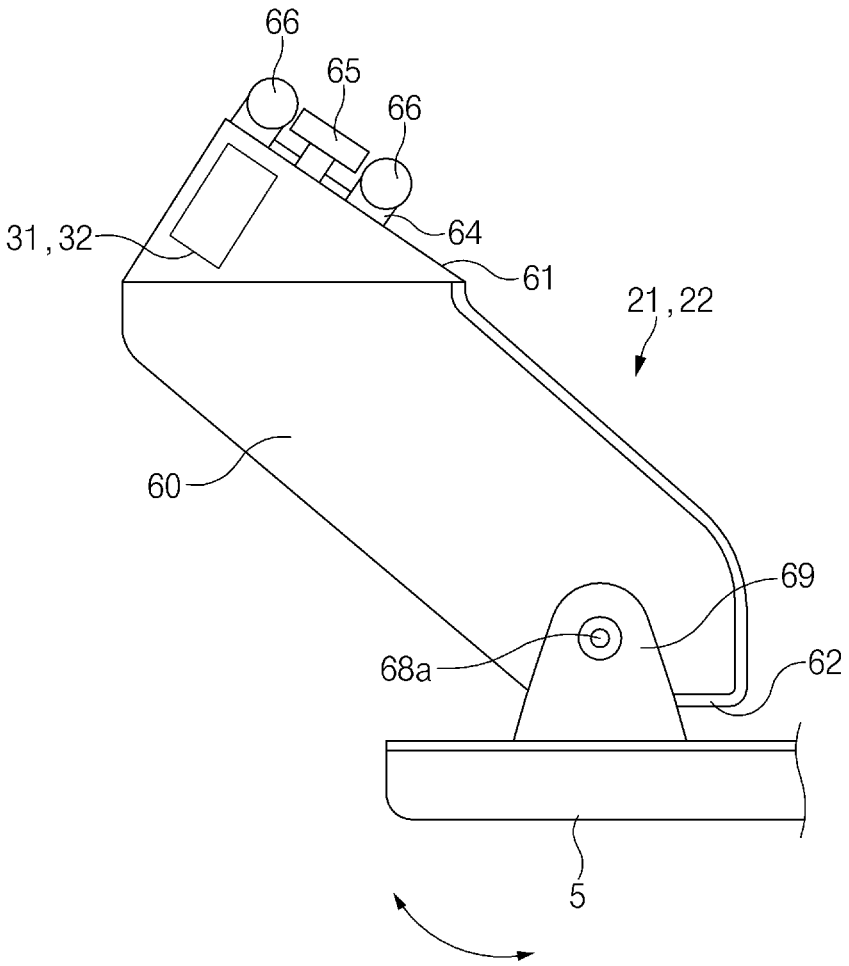
FIG. 8 illustrates an upper roller unit and a lower roller unit in a vehicle door opening and closing apparatus according to another exemplary embodiment of the present disclosure.

According to another exemplary embodiment, as illustrated in FIGS. 8 and 9, the first end portion 61 of the body 60 may be fixed to the roller bracket 64, and the second end portion 62 of the body 60 may be pivotally connected to the vehicle door 5 through a pivot pin 68*a*. Thus, the vehicle door 5 may swing around the pivot pin 68*a* adjacent to the second end portion 62 of the body 60.

Referring to FIGS. 8 and 9, the roller bracket 64 may be fixed to the first end portion 61 of the body 60 by welding, using fasteners, and/or the like. The second end portion 62 of the body 60 may be pivotally connected to the vehicle door 5 through the pivot pin 68*a*. The vehicle door 5 may have a pivot lug 69 protruding toward the body 60, and the pivot lug 69 may be pivotally connected to the second end portion 62 of the body 60 through the pivot pin 68*a*. The second end portion 62 of the body 60 may be shaped so as not to interfere with the vehicle door 5 when the vehicle door 5 swings. The upper rotation axis CX1 and the lower rotation axis CX2 may be defined by the pivot pin 68*a*. For example, the upper rotation axis CX1 and the lower rotation axis CX2 may be a virtual axis extending vertically along a center point of the pivot pin 68*a*, and the upper rotation axis CX1 and the lower rotation axis CX2 may be vertically aligned, so that the vehicle door 5 may swing around the vertical rotation axis that virtually connects the upper rotation axis CX1 and the lower rotation axis CX2. The upper hold lock 31 may be fixed to the body 60 of the upper roller unit 21, and the lower hold lock 32 may be fixed to the body 60 of the lower roller unit 22.

Referring to FIG. 9, when the upper hold lock 31 firmly holds the roller bracket 64 of the upper roller unit 21 in the first closed position CP1, and the lower hold lock 32 firmly holds the roller bracket 64 of the lower roller unit 22 in the first closed position CP1, the vehicle door 5 may swing around the upper rotation axis CX1 of the upper roller unit 21 and the lower rotation axis CX2 of the lower roller unit 22. Thus, the vehicle door 5 may move between the second closed position CP2 in which the vehicle door 5 is closed and the second open position OP2 in which the vehicle door 5 is opened.

According to the exemplary embodiment illustrated in FIGS. 8 and 9, as the pivot pin 68*a* is located between the second end portion 62 of the body 60 and the vehicle door 5, the rotation axes CX1 and CX2 of the vehicle door 5 may be relatively close to the vehicle door 5. Since a rotation radius R2 of the vehicle door 5 is relatively shortened, a gap S2 between the vehicle door 5 and another adjacent door 4 may be relatively reduced, resulting in improved exterior styling. Even though the rotation axes CX1 and CX2 of the vehicle door 5 are close to the vehicle door 5, a swing trajectory T2 of the vehicle door 5 is not reduced, and thus an open space created by the swing of the vehicle door 5 may not be narrowed.

Figure 11:
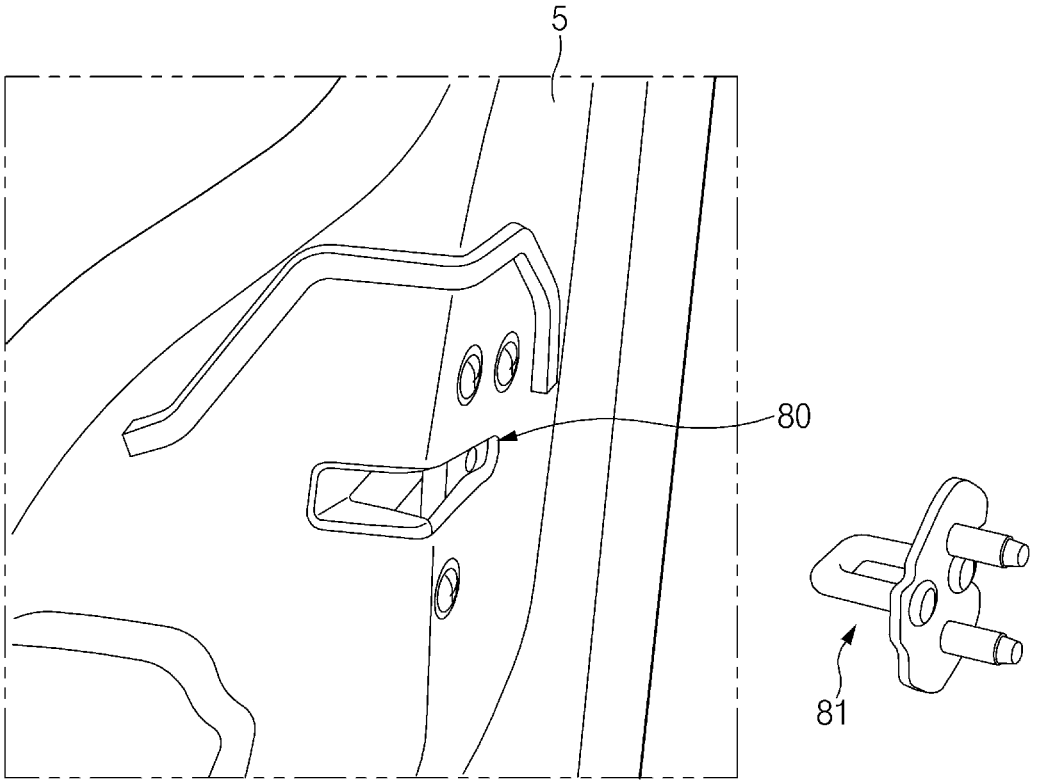
FIG. 11 illustrates a main latch mounted on a vehicle door and a main striker.

Referring to FIG. 11, a main latch 80 may be mounted on a rear end of the vehicle door 5, and a main striker 81 may be fixed to the vehicle body 1. The main latch 80 may releasably engage with the main striker 81. When the vehicle door 5 is in the first closed position CP1 or the second closed position CP2, the main latch 80 may engage with the main striker 81 by an engaging operation of the outside handle 6 so that the vehicle door 5 may be locked in the first closed position CP1 or the second closed position CP2. When the vehicle door 5 is in the first closed position CP1 or the second closed position CP2, the main latch 80 may release the main striker 81 by a release operation of the outside handle 6 so that the vehicle door 5 may be allowed to move in the sliding mode or the swing mode. When the vehicle door 5 is held in the first closed position CP1 and the main latch 80 releases the main striker 81, a center roller unit 23 may be released from the center rail 13, and thus the vehicle door 5 may be opened and closed in the swing mode.

The vehicle door opening and closing apparatus, according to exemplary embodiments of the present disclosure, may further include the center rail 13 mounted at a central portion of the vehicle body 1, and the center roller unit 23 guided along the center rail 13.

Referring to FIGS. 1 and 3, the center rail 13 may extend from a rear edge of the door aperture 3 along the longitudinal direction of the vehicle. The center roller unit 23 may be pivotally mounted at a central portion of the vehicle door 5. In particular, the center roller unit 23 may be mounted in a position adjacent to the rear end of the vehicle door 5. The center roller unit 23 may be guided along the center rail 13.

Figure 12:
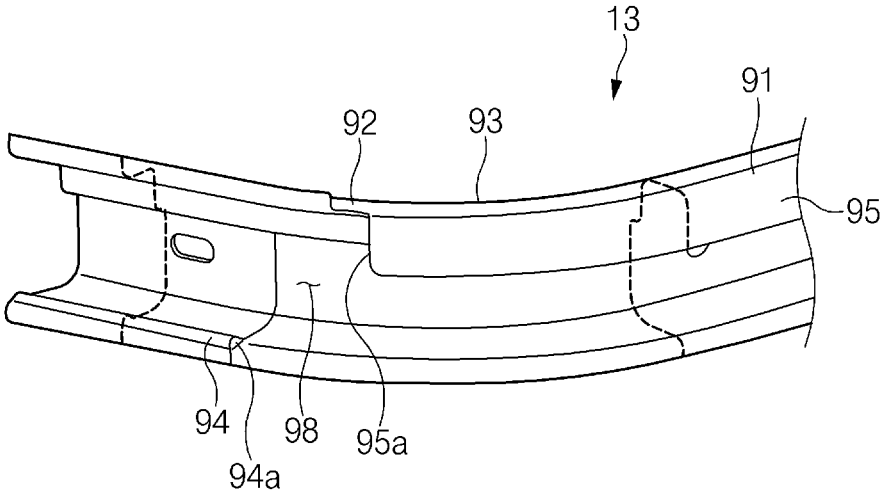
FIG. 12 illustrates a perspective view of a center rail in a vehicle door opening and closing apparatus according to an exemplary embodiment of the present disclosure.

Referring to FIG. 12, the center rail 13 may include a sliding guide 91 extending straightly in the longitudinal direction of the vehicle, and a swing guide 92 extending from the sliding guide 91 toward the interior side of the vehicle. The swing guide 92 may be bent at a predetermined angle with respect to the sliding guide 91 through a bending portion 93, and the bending portion 93 may be curved at a predetermined radius.

Figure 13:
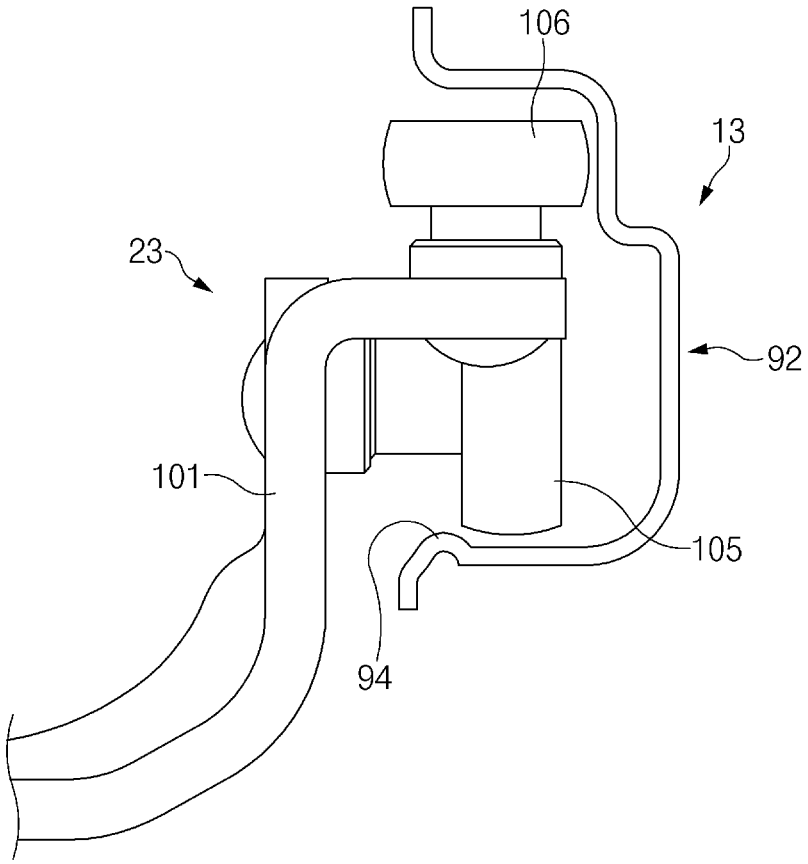
FIG. 13 illustrates a cross-sectional view of a swing guide of a center rail.
Figure 14:
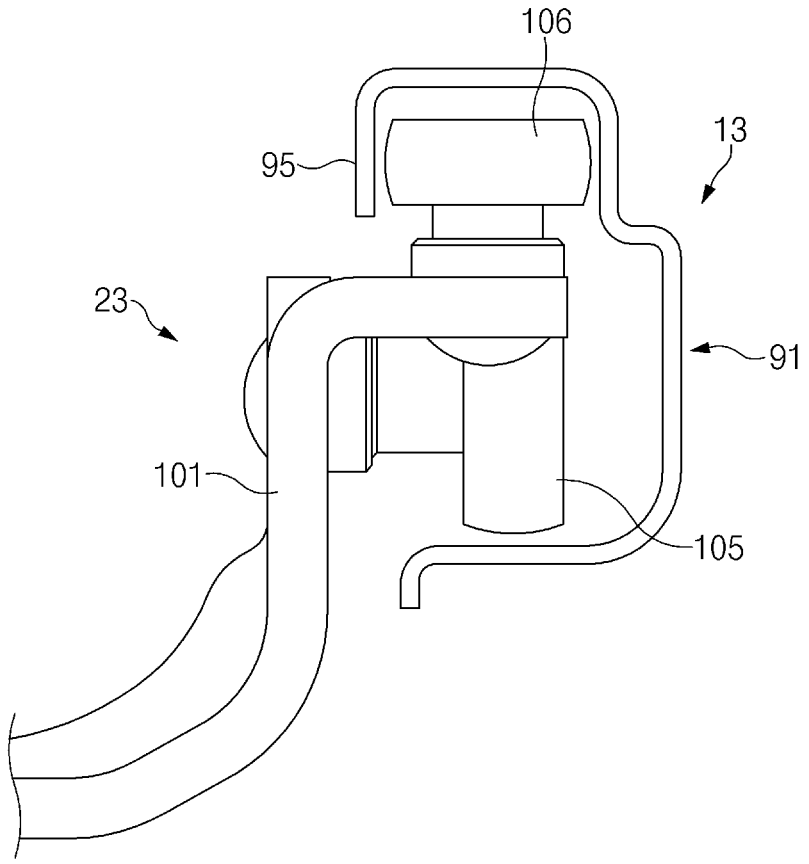
FIG. 14 illustrates a cross-sectional view of a sliding guide of a center rail.
Figure 15:
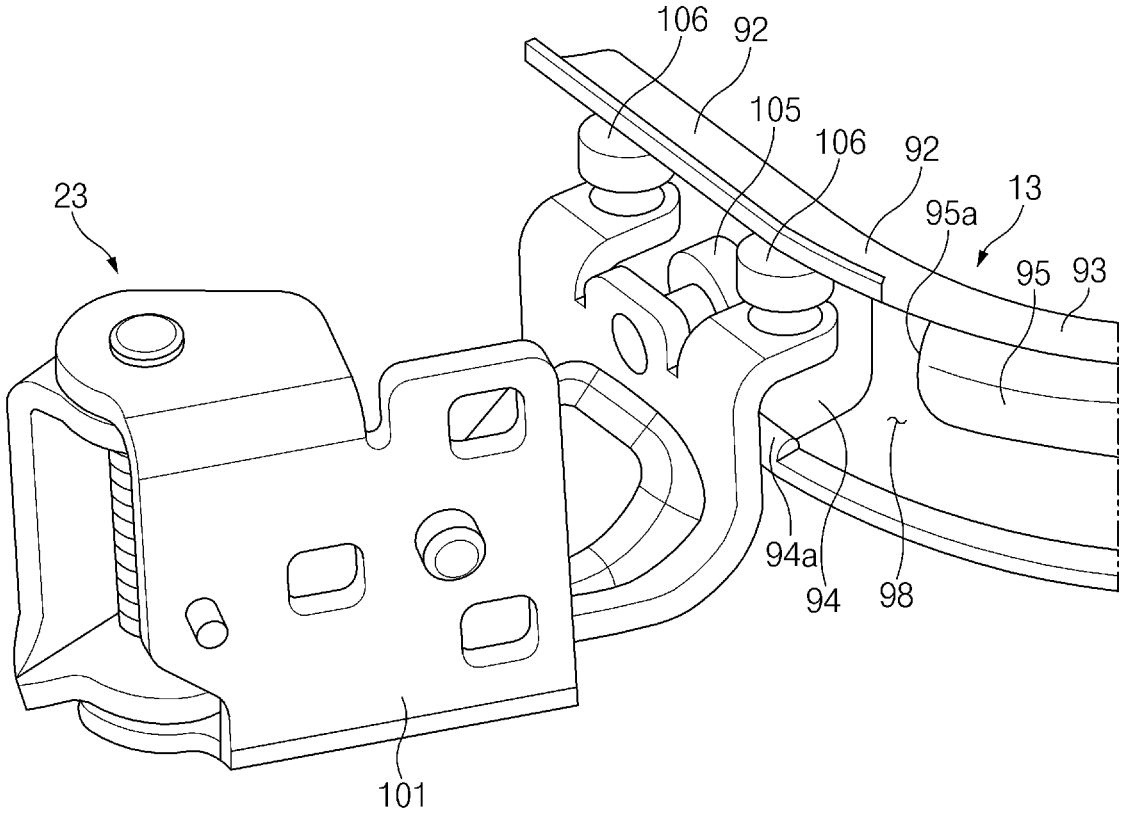
FIG. 15 illustrates a structure in which a center roller unit is held in a swing guide of a center rail.

Referring to FIGS. 13 to 15, the center roller unit 23 may include a roller bracket 101 and rollers 105 and 106 rotatably mounted on the roller bracket 101. The roller bracket 101 may be pivotally mounted at the central portion of the vehicle door 5. The rollers 105 and 106 may roll along the center rail 13. As illustrated in FIG. 15, a middle roller 105 and two side rollers 106 disposed on opposite sides of the middle roller 105 may be rotatably mounted on the roller bracket 101. A rotation axis of the middle roller 105 may be orthogonal to a rotation axis of the side roller 106.

When the vehicle door 5 slides in the longitudinal direction of the vehicle as the sliding mode is selected, the sliding guide 91 may guide the rollers 105 and 106 of the center roller unit 23.

Referring to FIGS. 12 and 14, the sliding guide 91 may include a stopper wall 95 preventing the rollers 105 and 106 of the center roller unit 23 from being separated from the sliding guide 91. The stopper wall 95 may extend along a length of the sliding guide 91 and a length of the bending portion 93. The stopper wall 95 may protrude vertically downward from the top of the sliding guide 91. As the stopper wall 95 closes an upper area of the sliding guide 91 and an upper area of the bending portion 93, the center roller unit 23 may be prevented from moving away from the sliding guide 91 toward the exterior side of the vehicle as illustrated in FIG. 14.

When the vehicle door 5 is opened and closed in the swing mode as the swing mode is selected, the swing guide 92 may guide the rollers 105 and 106 of the center roller unit 23 to be released from the center rail 13.

An exterior side of the swing guide 92 may be entirely opened toward the exterior space of the vehicle. A guide projection 94 may protrude upwardly from the bottom of the swing guide 92, and the guide projection 94 may extend along a length of the swing guide 92. When the vehicle door 5 swings from the second closed position CP2 to the second open position OP2 along the swing trajectory T1 or T2, the middle roller 105 of the center roller unit 23 may be guided along the guide projection 94 as illustrated in FIG. 13.

Figure 16:
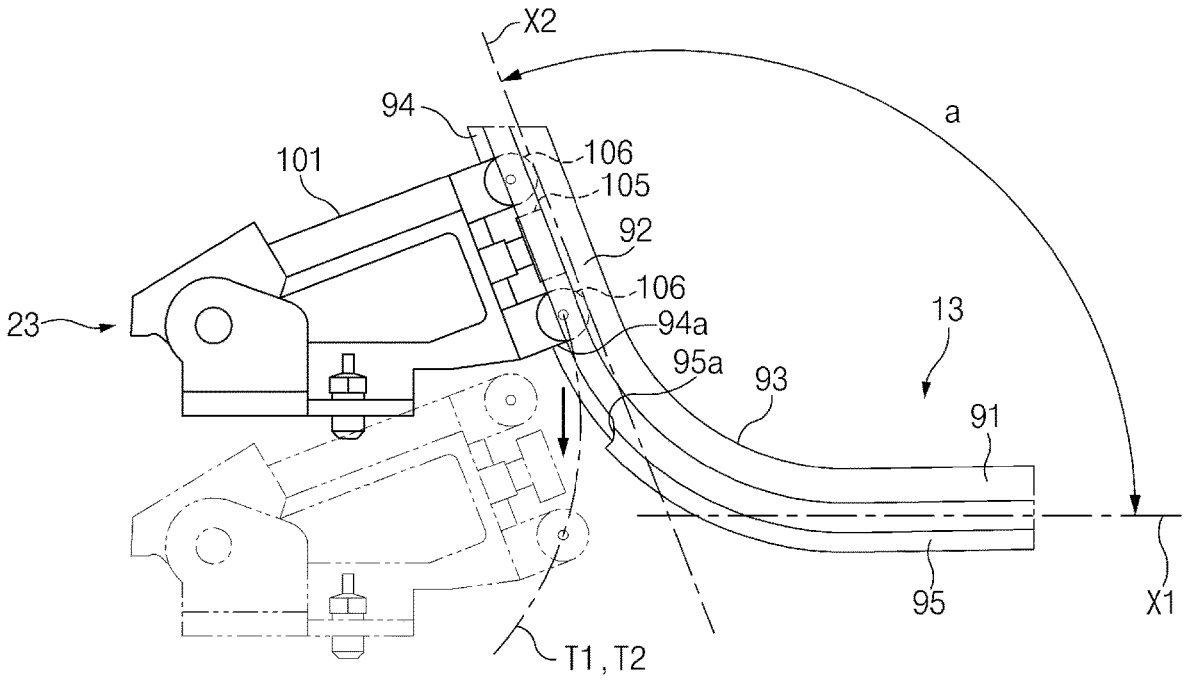
FIG. 16 illustrates an operation in which a center roller unit is released from a swing guide of a center rail.

A front end 95*a* of the stopper wall 95 of the sliding guide 91 and a rear end 94*a* of the guide projection 94 may be located so as not to interfere with the swing trajectories T1 and T2 of the vehicle door 5. In addition, as illustrated in FIG. 16, an axis X1 of the sliding guide 91 and an axis X2 of the swing guide 92 may intersect at a predetermined angle a. In particular, the angle a of intersection between the axis X1 of the sliding guide 91 and the axis X2 of the swing guide 92 may be an obtuse angle, so that the center roller unit 23 may easily be released from the swing guide 92 of the center rail 13 or may easily be received in the swing guide 92 of the center rail 13. The center rail 13 may include a space 98 allowing the rollers 105 and 106 of the center roller unit 23 to be released from the center rail 13 or to be received in the center rail 13 when the vehicle door 5 swings in the swing mode. The space 98 may be defined between the front end 95*a* of the stopper wall 95 and the rear end 94*a* of the guide projection 94 as the front end 95*a* of the stopper wall 95 and the rear end 94*a* of the guide projection 94 are spaced apart from each other. Due to the space 98, there is no interference when the rollers 105 and 106 of the center roller unit 23 are released from the center rail 13 or are received in the center rail 13 in the swing mode.

Meanwhile, when the main latch 80 malfunctions in the sliding mode or the vehicle door 5 or the swing guide 92 is deformed due to an external impact, the rollers 105 and 106 of the center roller unit 23 may be separated from the swing guide 92 of the center rail 13, and thus the vehicle door 5 may not be easily opened and closed in the sliding mode. In order to deal with this problem, the vehicle door opening and closing apparatus, according to exemplary embodiments of the present disclosure, may further include a flap mechanism 110 preventing the rollers 105 and 106 of the center roller unit 23 from being separated from the center rail 13 in the sliding mode. In particular, the flap mechanism 110 may be mounted on the swing guide 92 of the center rail 13, thereby preventing the rollers 105 and 106 of the center roller unit 23 from being separated from the swing guide 92 of the center rail 13 in the sliding mode.

Referring to FIGS. 17 to 23, the flap mechanism 110 according to an exemplary embodiment may allow the rollers 105 and 106 of the center roller unit 23 to be released from or received in the swing guide 92 in the swing mode, and prevent the rollers 105 and 106 of the center roller unit 23 from being separated from the swing guide 92 in the sliding mode.

The flap mechanism 110 may include a flap 120 rotatably mounted on the swing guide 92 of the center rail 13, and a locking lever 130 releasably engaging with the flap 120.

The swing guide 92 may include a top wall 92*a*, an inboard side wall 92*b* facing the interior space of the vehicle, a bottom wall 92*c*, an opening 92*d* opened toward the exterior space of the vehicle, and a cavity 92*e*. The cavity 92*e* may be defined by the top wall 92*a*, the inboard side wall 92*b*, and the bottom wall 92*c* and the cavity 92*e* may receive the rollers 105 and 106 of the center roller unit 23.

Figure 17:
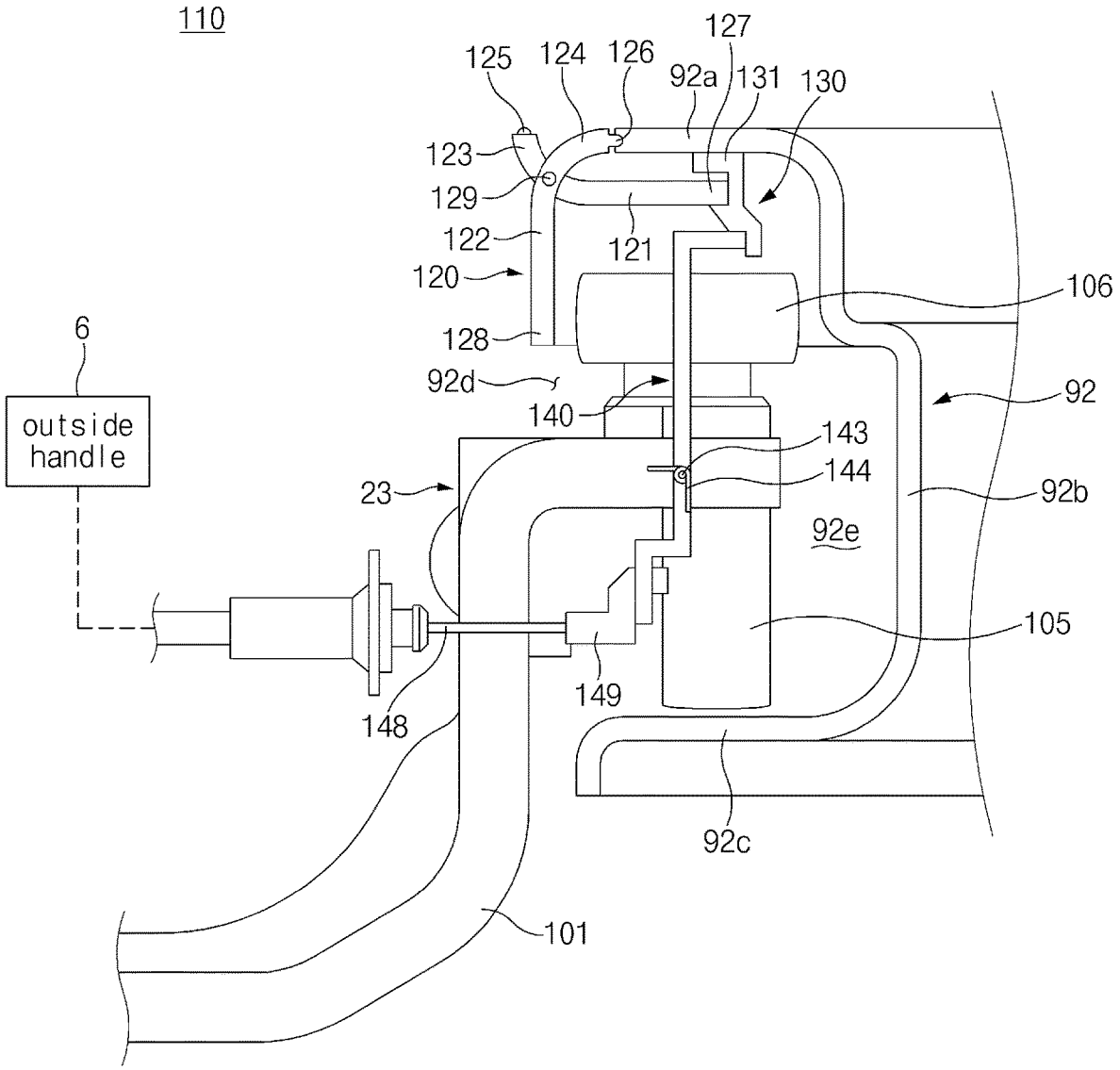
FIG. 17 illustrates a flap mechanism according to an exemplary embodiment of the present disclosure.

Referring to FIG. 17, the flap 120 may block or close at least a portion of the opening 92*d* of the swing guide 92, especially an upper portion of the swing guide 92 facing the side rollers 106 mounted on the roller bracket 101. The flap 120 may be rotatably mounted on the top wall 92*a* of the swing guide 92 through a hinge pin 129. The flap 120 may include a first flap portion 121 and a second flap portion 122 orthogonal to the first flap portion 121. The first flap portion 121 may have a first free end 127, and the first free end 127 of the first flap portion 121 may releasably engage with the locking lever 130. An axis of the second flap portion 122 may be orthogonal to an axis of the first flap portion 121, and the second flap portion 122 may have a second free end 128. In addition, the flap 120 may include a first extension portion 123 bent at a predetermined angle with respect to the axis of the first flap portion 121, a first projection 125 protruding from an end of the first extension portion 123, a second extension portion 124 bent at a predetermined angle with respect to the axis of the second flap portion 122, and a second projection 126 protruding from an end of the second extension portion 124. The first flap portion 121 and the second flap portion 122 may have an area sufficient to cover the upper portion of the opening 92*d* of the swing guide 92.

When the first flap portion 121 engages with the locking lever 130, the second flap portion 122 may block at least a portion of the opening 92*d* of the swing guide 92 to keep the portion of the opening 92*d* in a closed state, and thus the rollers 105 and 106 of the center roller unit 23 may be prevented from being separated from the swing guide 92.

When the first flap portion 121 is released from the locking lever 130, the flap 120 may freely rotate, and thus the rollers 105 and 106 of the center roller unit 23 may be released from the swing guide 92 or may be received in the cavity 92*e* of the swing guide 92.

Figure 18:
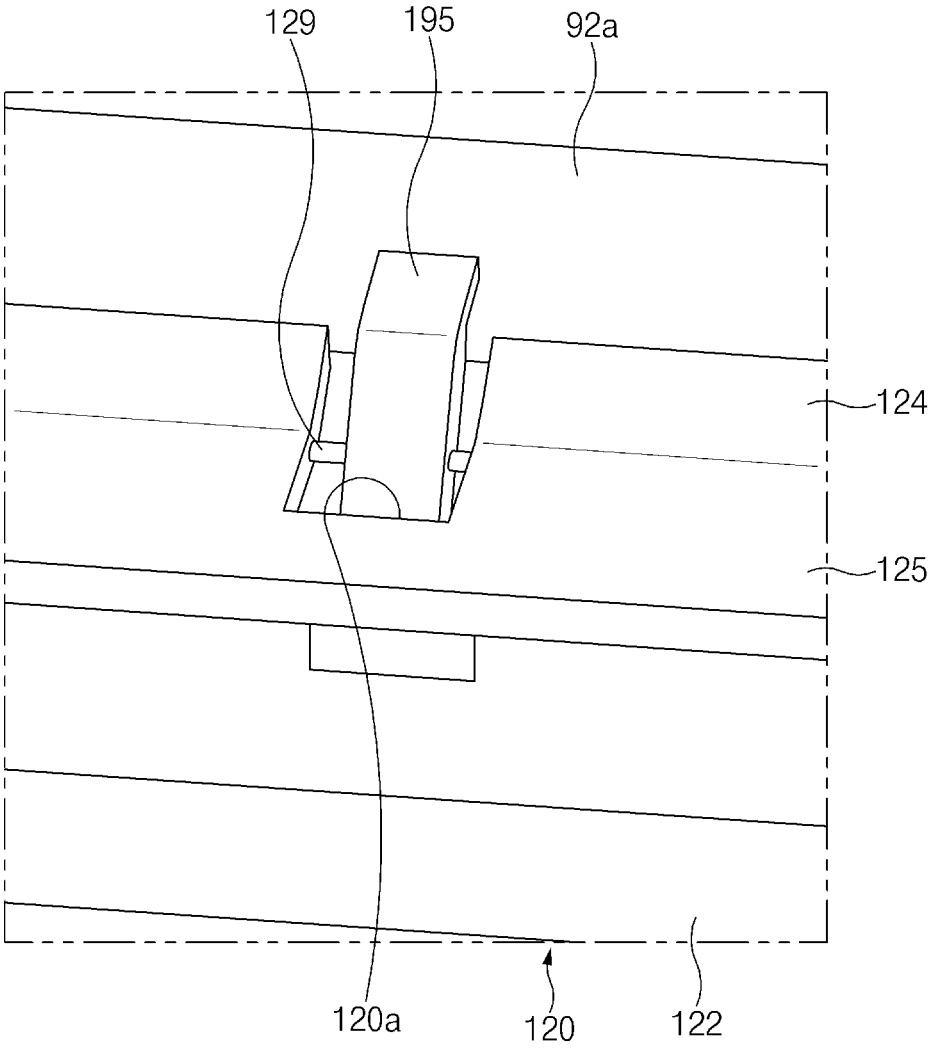
FIG. 18 illustrates a perspective view of a flap illustrated in FIG. 17, which is rotatably mounted on a swing guide.

Referring to FIG. 18, the swing guide 92 may have a hinge lug 195 protruding from the top wall 92*a* toward the flap 120, and the flap 120 may have an opening 120*a* in which the hinge lug 195 is received. The opening 120*a* may be formed in the first extension portion 123 and the second extension portion 124. Thus, the flap 120 may be rotatably mounted with respect to the hinge lug 195 of the swing guide 92 through the hinge pin 129.

Figure 20:
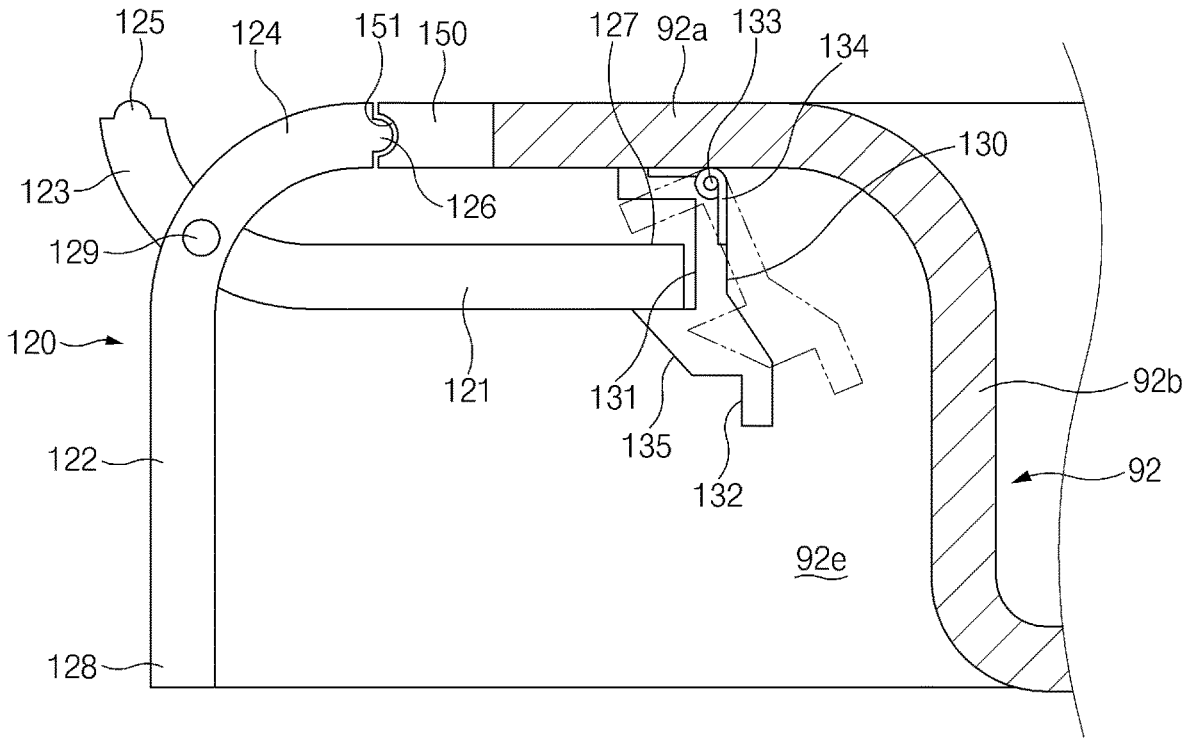
FIG. 20 illustrates a state in which the flap of the flap mechanism illustrated in FIG. 17 closes the swing guide.
Figure 21:
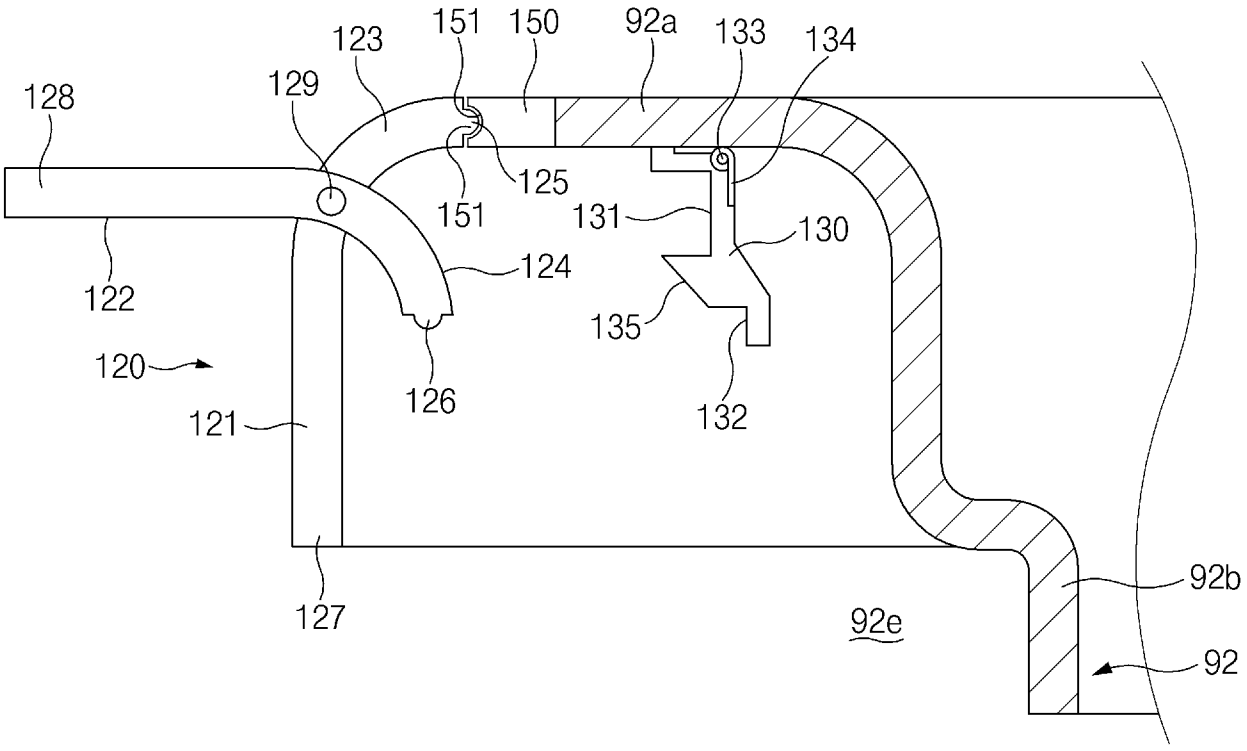
FIG. 21 illustrates a state in which the flap of the flap mechanism illustrated in FIG. 17 is freely rotatable on the swing guide.

Referring to FIGS. 20 and 21, the locking lever 130 may be rotatably mounted on the top wall 92*a* of the swing guide 92 through a first hinge pin 133. The locking lever 130 may have a locking recess 131 in which the first free end 127 of the first flap portion 121 of the flap 120 is received.

The locking lever 130 may move between an engaging position (see the solid line in FIG. 20) in which it engages with the first free end 127 of the first flap portion 121 and a release position (see the dotted line in FIG. 20) in which it releases the first free end 127 of the first flap portion 121.

The locking lever 130 may be biased toward the engaging position by a first biasing element 134. For example, the first biasing element 134 may be a torsion spring disposed around the first hinge pin 133.

In addition, the locking lever 130 may include a release shoulder 132 located below the locking recess 131. As a release lever 140 pushes the release shoulder 132, the locking lever 130 may move to the release position (see the dotted line in FIG. 20).

An inclined surface 135 may be formed between the locking recess 131 and the release shoulder 132, and the first free end 127 of the first flap portion 121 of the flap 120 may be easily inserted into the locking recess 131 by moving on the inclined surface 135.

Referring to FIGS. 20 and 21, the flap mechanism no may further include a stopper 150 restricting the position of the flap 120. The stopper 150 may be attached to the top wall 92*a* of the swing guide 92 of the center rail 13, and the stopper 150 may have a recess 151 in which one of the first projection 125 and the second projection 126 is releasably received.

Figure 22:
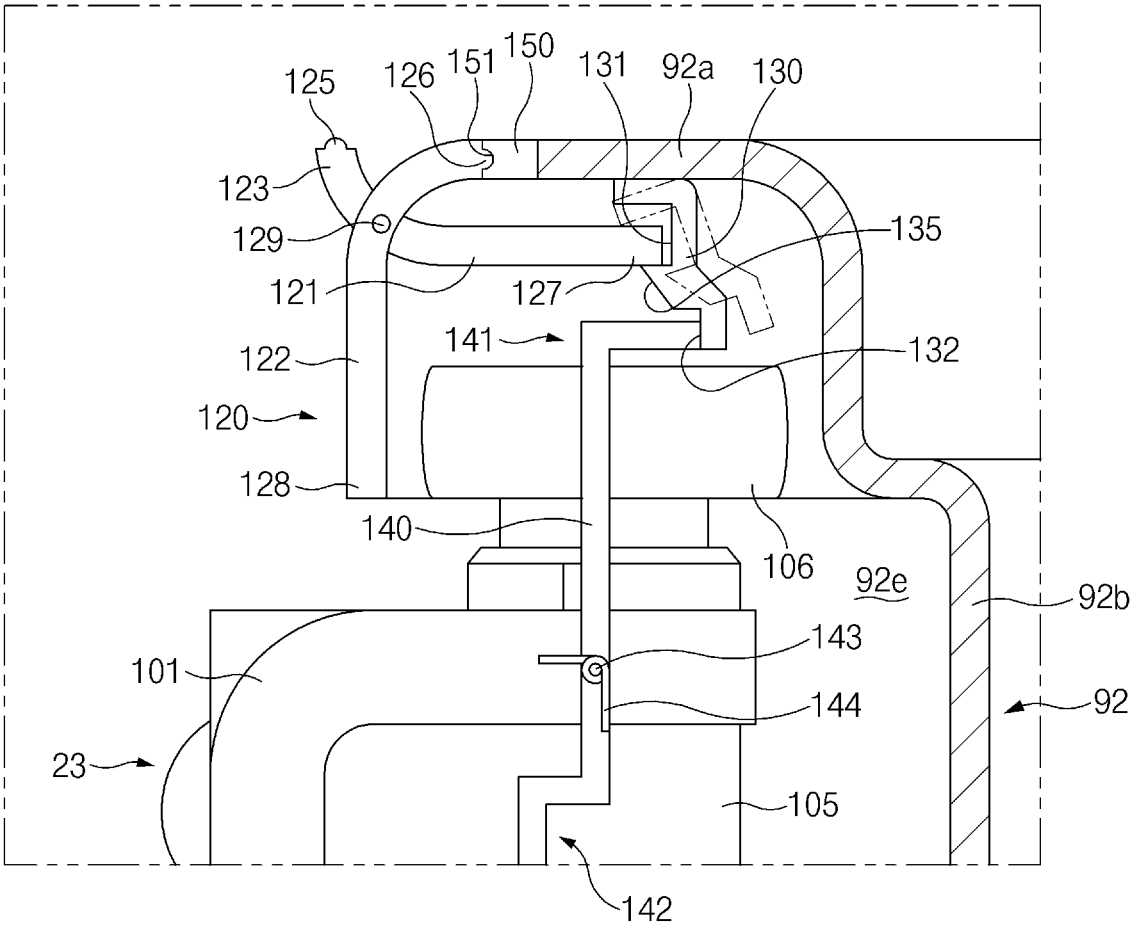
FIG. 22 illustrates a state in which a center roller unit is received in the swing guide as the flap of the flap mechanism illustrated in FIG. 17 closes the swing guide.

As illustrated in FIGS. 20 and 22, when the locking lever 130 engages with the first free end 127 of the first flap portion 121, the second projection 126 of the second flap portion 122 may be received in the recess 151 of the stopper 150, and the first free end 127 of the first flap portion 121 may be received in the locking recess 131 of the locking lever 130 so that the flap 120 may keep at least the portion of the opening 92*d* of the swing guide 92 in the closed state.

As illustrated in FIG. 21, when the locking lever 130 releases the first free end 127 of the first flap portion 121, the first free end 127 of the first flap portion 121 may be released from the locking recess 131 of the locking lever 130, and the first projection 125 of the first flap portion 121 may be received in the recess 151 of the stopper 150 so that the first free end 127 of the first flap portion 121 or the second free end 128 of the second flap portion 122 may be kept in a released state from the locking lever 130. When the center roller unit 23 moves toward the interior or exterior of the vehicle, the center roller unit 23 may push the flap 120 toward the interior or exterior of the vehicle so that the flap 120 may rotate freely. That is, the rollers 105 and 106 of the center roller unit 23 may push the first flap portion 121 or the second flap portion 122 of the flap 120 toward the interior or exterior of the vehicle so that the center roller unit 23 may be released from or be received in the swing guide 92.

Figure 19:
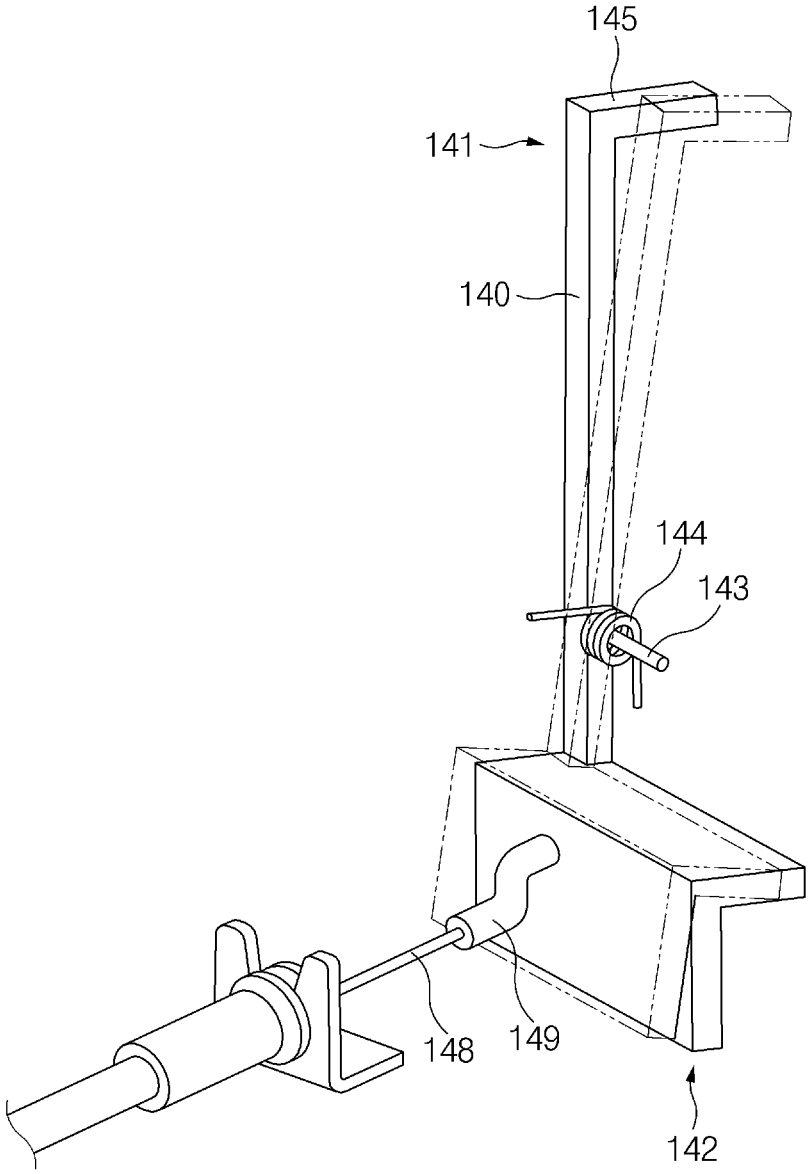
FIG. 19 illustrates a perspective view of a release lever in the flap mechanism illustrated in FIG. 17.
Figure 23:
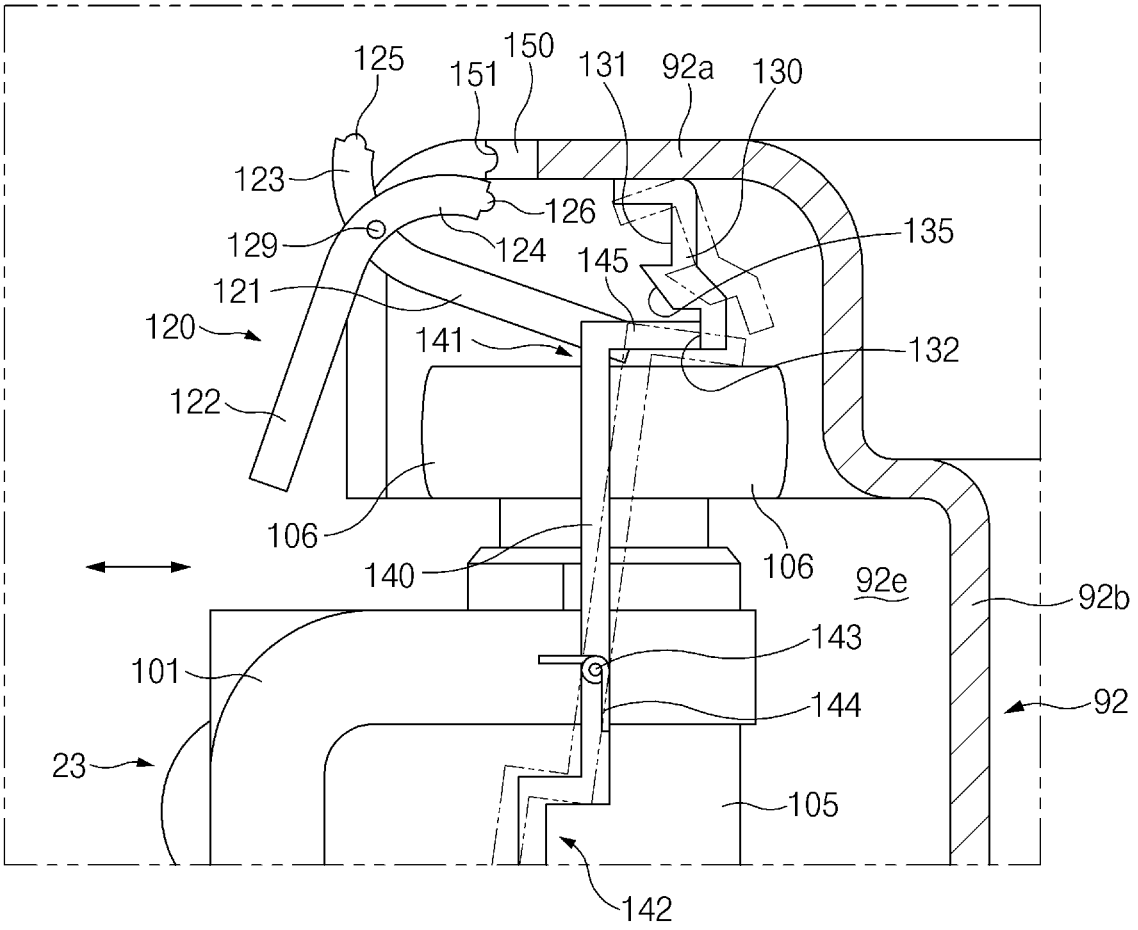
FIG. 23 illustrates a state in which the center roller unit is releasable from the swing guide as the flap of the flap mechanism illustrated in FIG. 17 is freely rotatable on the swing guide.

The locking lever 130 may move toward the release position by the release lever 140 as illustrated in FIG. 23. Referring to FIGS. 17 and 19, the release lever 140 may be rotatably mounted on the roller bracket 101 of the center roller unit 23 through a second hinge pin 143. The release lever 140 may include a first end portion 141 operatively connected to the locking lever 130 and a second end portion 142 connected to a cable 148.

The first end portion 141 may push the release shoulder 132 of the locking lever 130 so that the locking lever 130 may move to the release position. In particular, the release lever 140 may include a tip 145 extending from the first end portion 141 toward the locking lever 130, and the tip 145 may press the release shoulder 132 of the locking lever 130 so that the locking lever 130 may move to the release position. The cable 148 may be fixed to the second end portion 142 through an end fitting 149, and the cable 148 may be mechanically connected to the outside handle 6. As the outside handle 6 is pulled, the cable may be pulled, and thus the release lever 140 may rotate.

The release lever 140 may move between a lock position (see the solid line in FIGS. 22 and 23) and an unlock position (see the dotted line in FIG. 23). The lock position refers to a position in which the release lever 140 holds the locking lever 130 in the engaging position, and the unlock position refers to a position in which the release lever 140 moves the locking lever 130 to the release position. In particular, the release lever 140 may be biased toward the lock position by a second biasing element 144, and the second biasing element 144 may be a torsion spring disposed around the second hinge pin 143.

Referring to FIG. 22, the locking lever 130 may engage with the first flap portion 121 of the flap 120 so that the second flap portion 122 may keep the portion of the opening 92*d* of the swing guide 92 in the closed state. Thus, in the sliding mode, the center roller unit 23 may not be separated from the swing guide 92 of the center rail 13, and the center roller unit 23 may move along the center rail 13.

Referring to FIG. 23, the locking lever 130 may release the first flap portion 121 of the flap 120 so that the first flap portion 121 of the flap 120 may be kept in the released state from the locking lever 130. Thus, the flap 120 may freely rotate on the swing guide 92, and in the swing mode, the center roller unit 23 may be released from or be received in the swing guide 92 of the center rail 13.

Figure 24:
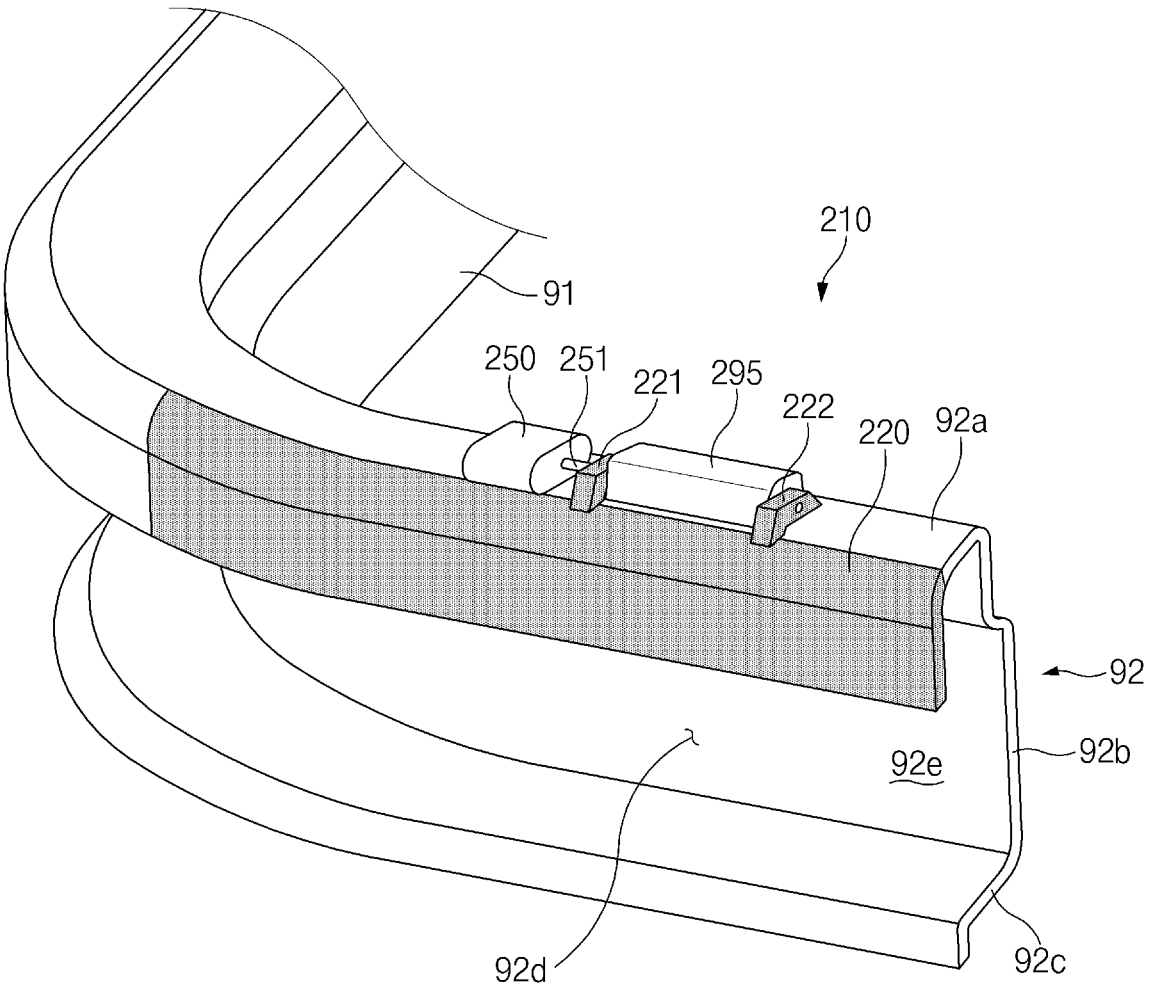
FIG. 24 illustrates a flap mechanism according to another exemplary embodiment of the present disclosure.
Figure 25:
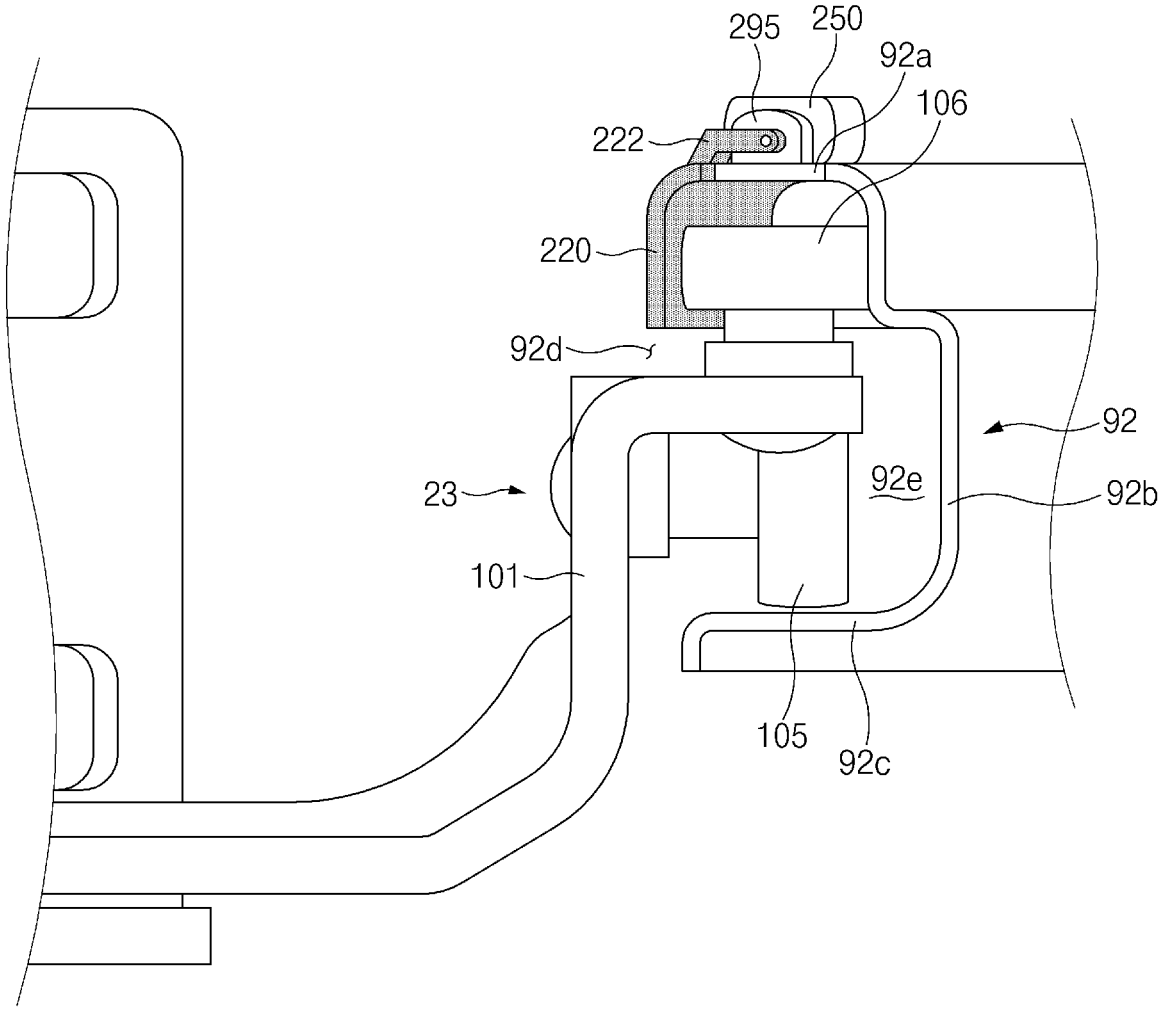
FIG. 25 illustrates a state in which a center roller unit is received in a swing guide as a flap of the flap mechanism illustrated in FIG. 24 closes the swing guide.
Figure 26:
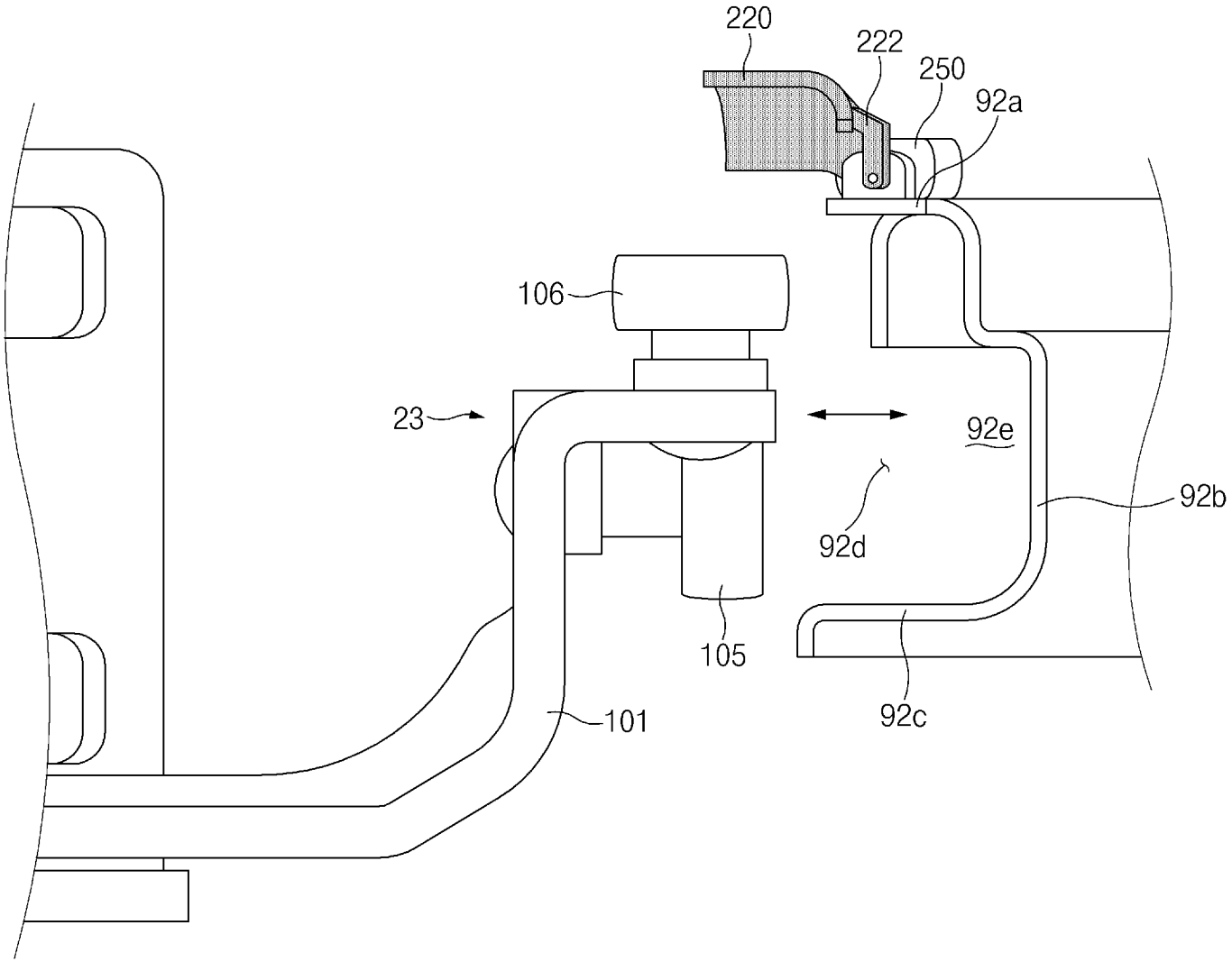
FIG. 26 illustrates a state in which the center roller unit is released from the swing guide as the flap of the flap mechanism illustrated in FIG. 24 opens the swing guide.

FIGS. 24 to 26 illustrate a flap mechanism 210 according to another exemplary embodiment of the present disclosure.

Referring to FIGS. 24 to 26, the flap mechanism 210 according to another exemplary embodiment of the present disclosure may include a flap 220 which is mounted to open and close the opening 92*d* of the swing guide 92, and a driving motor 250 which rotates the flap 220.

Referring to FIG. 24, the swing guide 92 may have a hinge lug 295 protruding from the top wall 92*a*, and the flap 220 may have a pair of hinge lugs 221 and 222. The pair of hinge lugs 221 and 222 may be connected to the hinge lug 295 of the swing guide 92 through a hinge pin so that the flap 220 may be rotatably mounted on the top wall 92*a* of the swing guide 92. The flap 220 may have an area sufficient to cover the upper portion of the opening 92*d* of the swing guide 92.

The driving motor 250 may be mounted on the top wall 92*a* of the swing guide 92, and a shaft 251 of the driving motor 250 may be connected to one of the pair of hinge lugs 221 and 222. By the rotation of the driving motor 250, the flap 220 may open and close at least a portion of the opening 92*d* of the swing guide 92.

The driving motor 250 may be electrically connected to the selector 40 of the outside handle 6, and its operation may be switched as the sliding mode or the swing mode is selected by the selector 40. For example, when the sliding mode is selected by the first switch 41, the driving motor 250 may operate the flap 220 to close the opening 92*d* of the swing guide 92, and when the swing mode is selected by the second switch 42, the driving motor 250 may operate the flap 220 to open the opening 92*d* of the swing guide 92.

Referring to FIG. 25, the driving motor 250 may operate to allow the flap 220 to close the opening 92*d* of the swing guide 92 so that the flap 220 may keep the opening 92*d* of the swing guide 92 in a closed state. Thus, in the sliding mode, the center roller unit 23 may not be separated from the swing guide 92 of the center rail 13, and the center roller unit 23 may move along the center rail 13.

Referring to FIG. 26, the driving motor 250 may operate to allow the flap 220 to open the opening 92*d* of the swing guide 92 so that the flap 220 may keep the opening 92*d* of the swing guide 92 in an open state. Thus, in the swing mode, the center roller unit 23 may be released from or be received in the swing guide 92 of the center rail 13.

Figure 27:
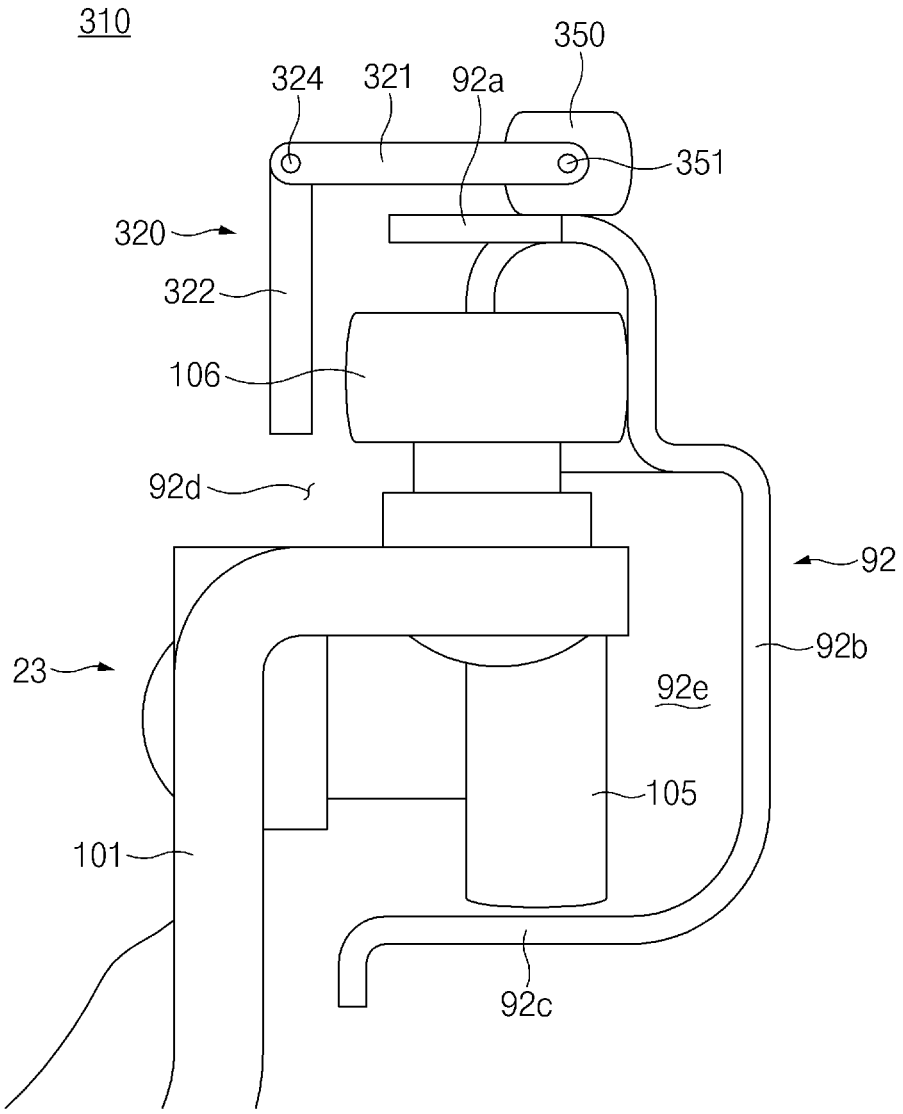
FIG. 27 illustrates a flap mechanism according to another exemplary embodiment of the present disclosure in a state in which a center roller unit is received in a swing guide as a flap closes the swing guide.
Figure 28:
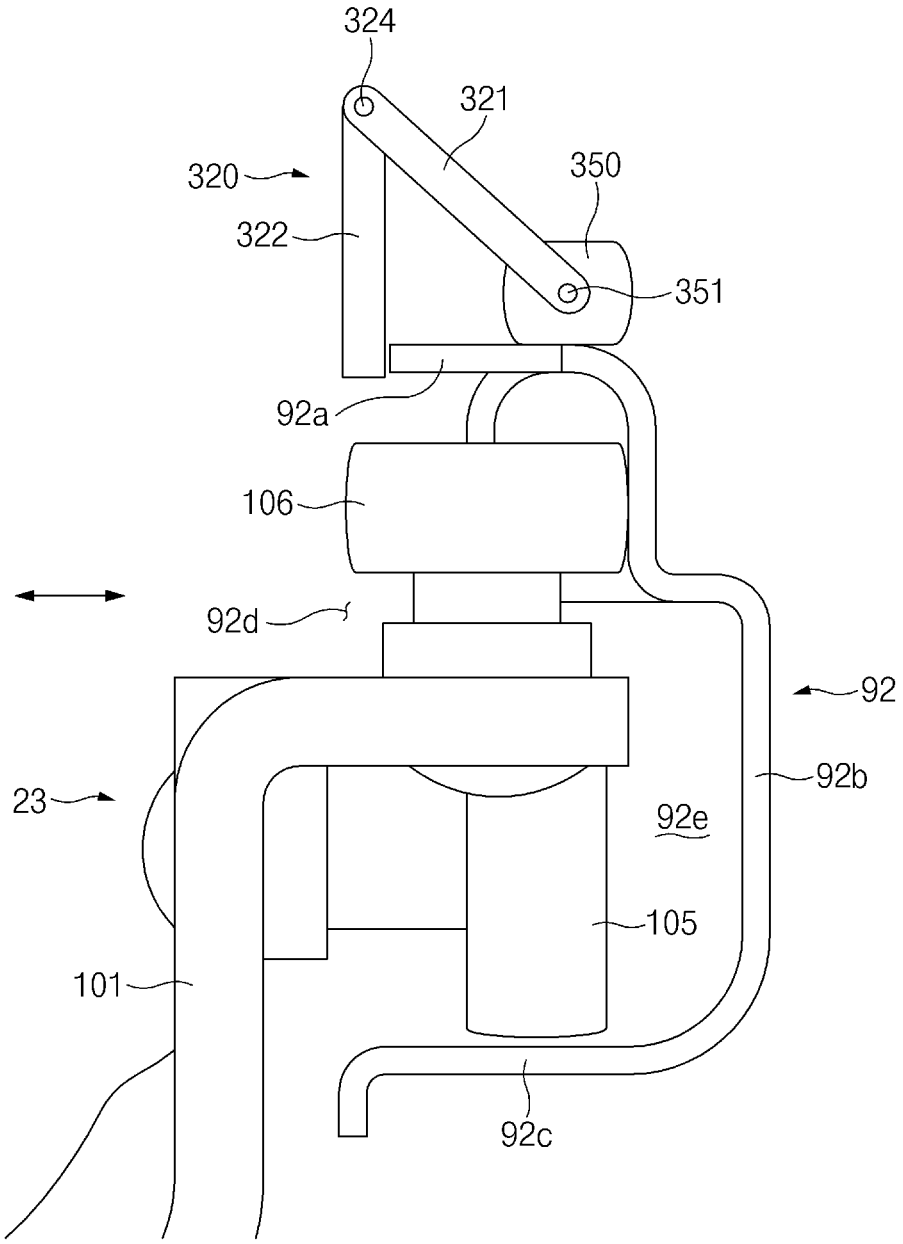
FIG. 28 illustrates a state in which the center roller unit is releasable from the swing guide as the flap of the flap mechanism illustrated in FIG. 27 opens the swing guide.

FIGS. 27 and 28 illustrate a flap mechanism 310 according to another exemplary embodiment of the present disclosure.

Referring to FIGS. 27 and 28, the flap mechanism 310 according to another exemplary embodiment of the present disclosure may include a flap 320 which is movable to open and close the opening 92*d* of the swing guide 92, and a driving motor 350 which drives the flap 320.

The flap 320 may include a first flap portion 321 and a second flap portion 322 rotatably connected to the first flap portion 321, and the first flap portion 321 may be rotated by the driving motor 350. A shaft 351 of the driving motor 350 may be connected to a first end portion of the first flap portion 321, so that the first flap portion 321 may be rotated by the driving motor 350. A first end portion of the second flap portion 322 may be rotatably connected to a second end portion of the first flap portion 321 through a hinge pin 324. The second flap portion 322 may have an area sufficient to cover the upper portion of the opening 92*d* of the swing guide 92.

The driving motor 3500 may be mounted on the top wall 92*a* of the swing guide 92, and the shaft 351 of the driving motor 350 may be connected to the first flap portion 321 so that the first flap portion 321 may rotate. As the first flap portion 321 rotates, the second flap portion 322 may move upwardly and downwardly, and thus the second flap portion 322 may open and close the opening 92*d* of the swing guide 92.

The driving motor 350 may be electrically connected to the selector 40 of the outside handle 6, and its operation may be switched as the sliding mode or the swing mode is selected by the selector 40. For example, when the sliding mode is selected by the first switch 41, the driving motor 350 may operate the flap 320 to close the opening 92*d* of the swing guide 92, and when the swing mode is selected by the second switch 42, the driving motor 350 may operate the flap 320 to open the opening 92*d* of the swing guide 92.

Referring to FIG. 27, the driving motor 250 may operate to allow the second flap portion 322 of the flap 320 to close the opening 92*d* of the swing guide 92 so that the flap 320 may keep the opening 92*d* of the swing guide 92 in a closed state. Thus, in the sliding mode, the center roller unit 23 may not be separated from the swing guide 92 of the center rail 13, and the center roller unit 23 may move along the center rail 13.

Referring to FIG. 28, the driving motor 250 may operate to allow the second flap portion 322 of the flap 320 to open the opening 92*d* of the swing guide 92 so that the flap 320 may keep the opening 92*d* of the swing guide 92 in an open state. Thus, in the swing mode, the center roller unit 23 may be released from or be received in the swing guide 92 of the center rail 13.

Figure 29:
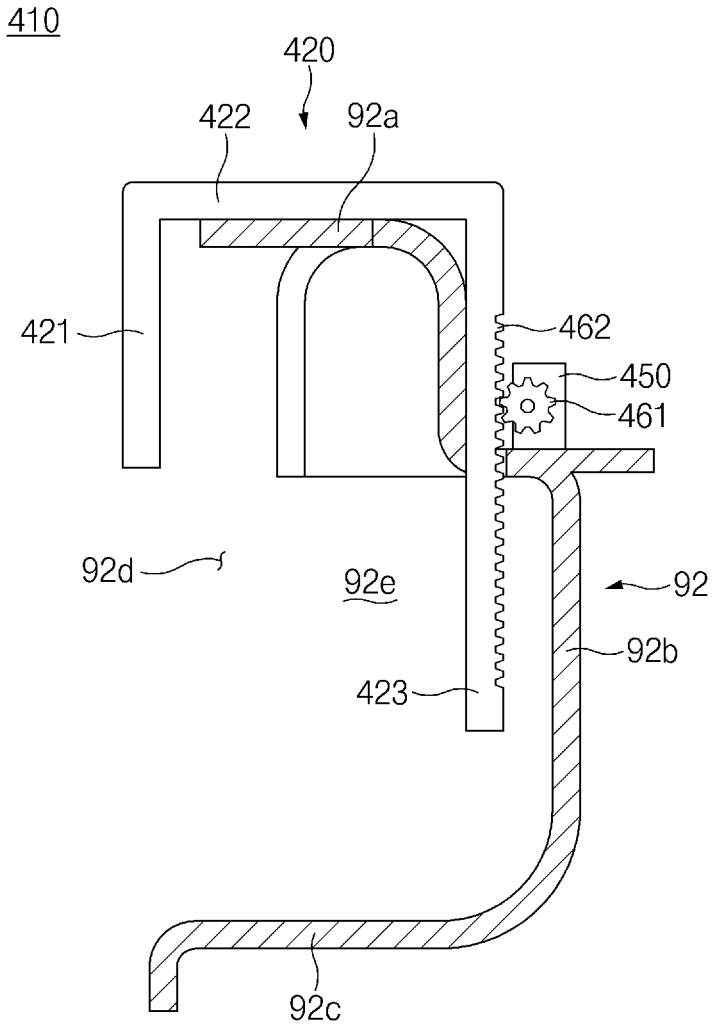
FIG. 29 illustrates a flap mechanism according to another exemplary embodiment of the present disclosure.
Figure 30:
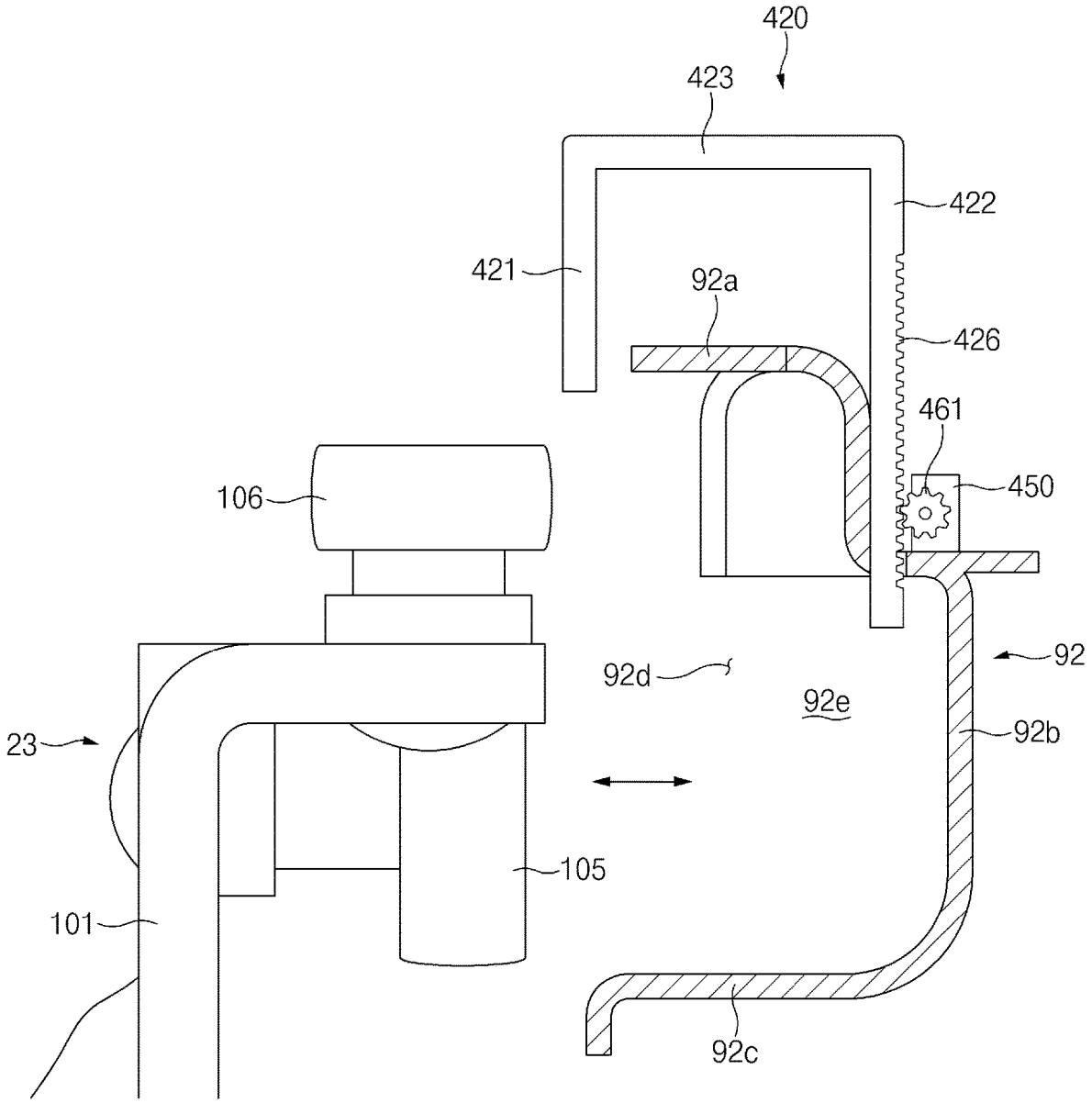
FIG. 30 illustrates a state in which a center roller unit is released from a swing guide as the flap of the flap mechanism illustrated in FIG. 29 opens the swing guide.

FIGS. 29 and 30 illustrate a flap mechanism 410 according to another exemplary embodiment of the present disclosure.

Referring to FIGS. 29 and 30, the flap mechanism 410 according to another exemplary embodiment of the present disclosure may include a flap 420 which is linearly movable to open and close the opening 92*d* of the swing guide 92, and a driving motor 450 which drives the flap 420.

The flap 420 may include a flap portion 421 linearly movable to open and close the opening 92*d* of the swing guide 92, an extension portion 422 extending from a top end of the flap portion 421 toward the inboard side wall 92*b* of the swing guide 92, and a guide 423 extending from the extension portion 422 toward the bottom wall 92*c* of the swing guide 92.

The guide 423 may be connected to the driving motor 450 through a rack and pinion. The guide 423 may have rack teeth 462, and a pinion 461 meshing with the rack teeth 462 may be connected to a shaft of the driving motor 450. As a rotation force of the driving motor 450 may be transmitted to the guide 423 through the pinion 461 and the rack teeth 462, the flap portion 421 may linearly move to open and close the opening 92*d* of the swing guide 92.

The driving motor 450 may be electrically connected to the selector 40 of the outside handle 6, and its operation may be switched as the sliding mode or the swing mode is selected by the selector 40. For example, when the sliding mode is selected by the first switch 41, the driving motor 450 may operate the flap 420 to close the opening 92*d* of the swing guide 92, and when the swing mode is selected by the second switch 42, the driving motor 450 may operate the flap 420 to open the opening 92*d* of the swing guide 92.

Referring to FIG. 29, the driving motor 450 may operate to allow the flap portion 421 of the flap 420 to close the opening 92*d* of the swing guide 92 so that the flap 420 may keep the opening 92*d* of the swing guide 92 in a closed state. Thus, in the sliding mode, the center roller unit 23 may not be separated from the swing guide 92 of the center rail 13, and the center roller unit 23 may move along the center rail 13.

Referring to FIG. 30, the driving motor 450 may operate to allow the flap portion 421 of the flap 420 to open the opening 92*d* of the swing guide 92 so that the flap 420 may keep the opening 92*d* of the swing guide 92 in an open state. Thus, in the swing mode, the center roller unit 23 may be released from or be received in the swing guide 92 of the center rail 13.

FIGS. 1 to 30 illustrate the vehicle door opening and closing apparatus according to exemplary embodiments of the present disclosure applied to the rear door 5. However, the vehicle door opening and closing apparatus according to exemplary embodiments of the present disclosure may be applied to various vehicle doors, such as front doors, in addition to rear doors.

Figure 31:
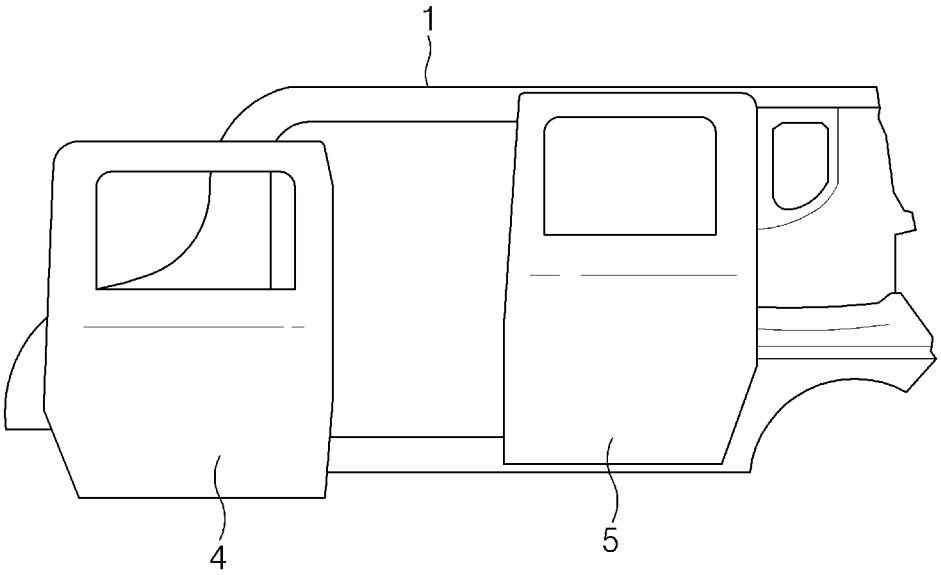
FIG. 31 illustrates a vehicle door opening and closing apparatus according to an exemplary embodiment of the present disclosure, which is applied to a front door of a vehicle, in a state in which the front door is opened in a sliding mode.
Figure 32:
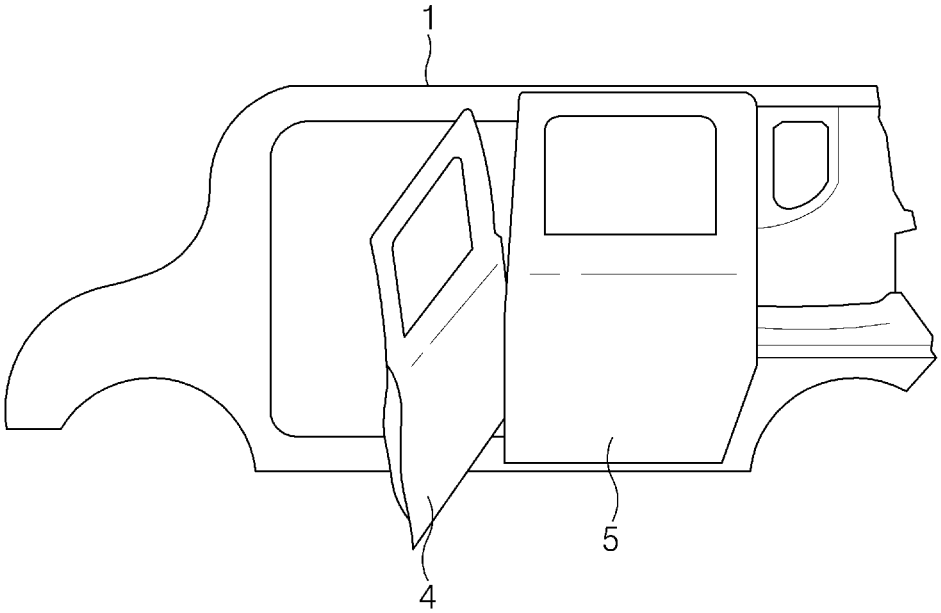
FIG. 32 illustrates a state in which the front door of FIG. 31 is opened in a swing mode.

FIGS. 31 and 32 illustrate the vehicle door opening and closing apparatus according to exemplary embodiments of the present disclosure applied to the front door 4. FIG. 31 illustrates a state in which the front door 4 is opened in the sliding mode, and FIG. 32 illustrates a state in which the front door 4 is opened in the swing mode.

Figure 33:
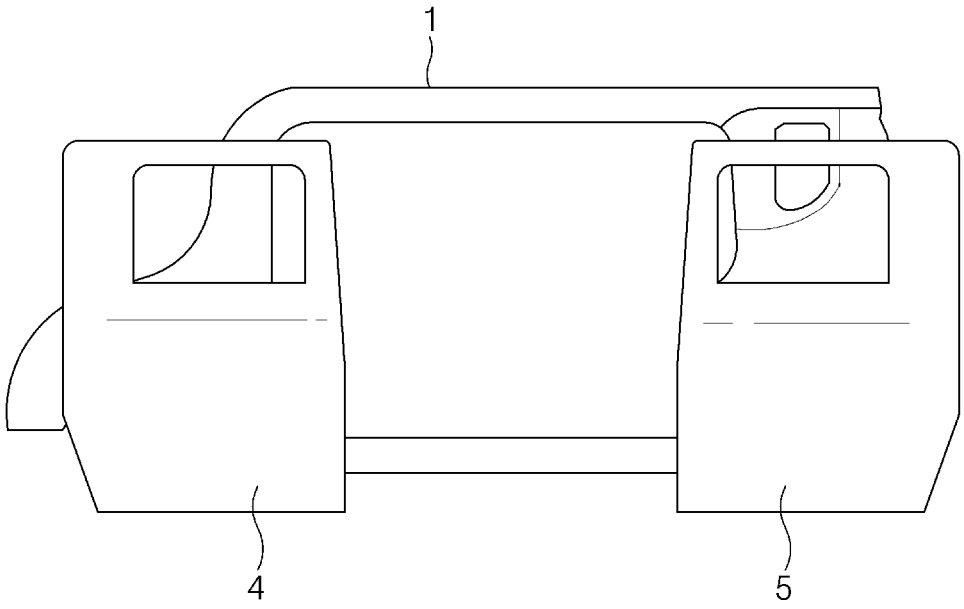
FIG. 33 illustrates a vehicle door opening and closing apparatus according to an exemplary embodiment of the present disclosure, which is applied to a front door and a rear door of a vehicle, in a state in which the front door and the rear door are opened in a sliding mode.
Figure 34:
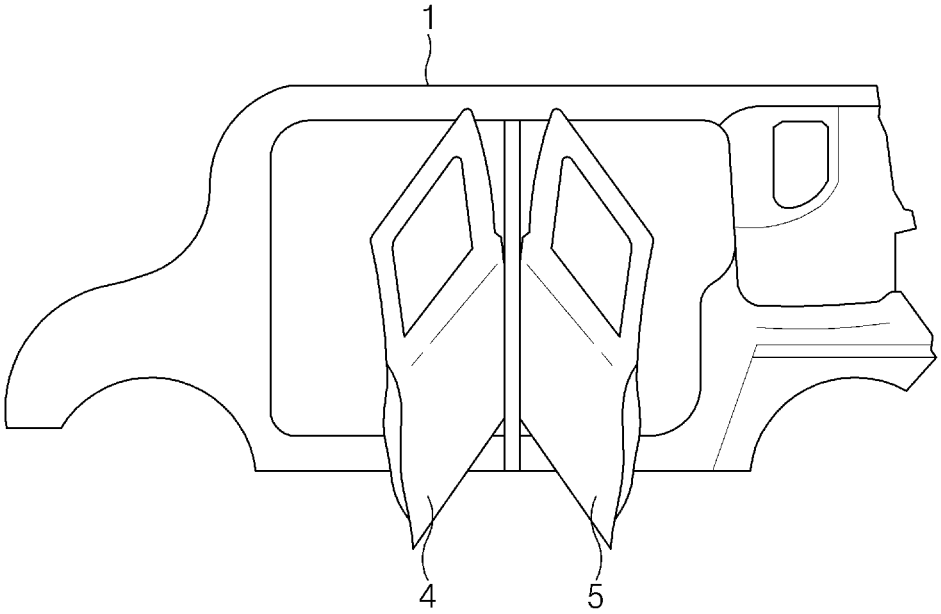
FIG. 34 illustrates a state in which the front door and the rear door of FIG. 33 are opened in a swing mode.

FIGS. 33 and 34 illustrate the vehicle door opening and closing apparatus according to exemplary embodiments of the present disclosure applied to both the front door 4 and the rear door 5. FIG. 33 illustrates a state in which the front door 4 and the rear door 5 are opened in the sliding mode, and FIG. 34 illustrates a state in which the front door 4 and the rear door 5 are opened in the swing mode.

As set forth above, the vehicle door opening and closing apparatus according to exemplary embodiments of the present disclosure may perform the opening and closing operations of the vehicle door by selectively switching the sliding mode and the swing mode, thereby meeting the needs of customers such as convenience and diversity. In addition, it may select the opening and closing operations of the vehicle door by taking the customer's situation and environment into consideration, thereby improving convenience and quality.

In particular, it may prevent the center roller unit from being separated from the center rail in the sliding mode, and allow the center roller unit to be released from the center rail in the swing mode, and thus the vehicle door may be reliably opened and closed in either the sliding mode or the swing mode.

In terms of vehicle specifications, the vehicle door opening and closing structure may be standardized, regardless of vehicle models. Thus, the manufacturing cost and investment cost may be significantly reduced.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A vehicle door opening and closing apparatus, comprising:

a rail configured to be mounted on a vehicle body;

a roller unit configured to be mounted on a vehicle door, move along the rail, and allow the vehicle door to open and close in a sliding mode and a swing mode;

a center rail configured to extend from a rear edge of a door aperture of the vehicle body;

a center roller unit configured to be guided along the center rail; and a flap mechanism configured to prevent the center roller unit from being separated from the center rail in the sliding mode, and to allow the center roller unit to be released from the center rail in the swing mode.

2. The apparatus according to claim 1, wherein the flap mechanism includes a flap configured to be rotatably mounted on the center rail, and a locking lever configured to releasably engage with the flap.

3. The apparatus according to claim 2, wherein the locking lever is configured to move between an engaging position, in which the locking lever engages with the flap, and a release position, in which the locking lever releases the flap.

4. The apparatus according to claim 3, wherein the locking lever is movable to the release position by a release lever.

5. The apparatus according to claim 4, wherein the release lever is configured to move between a lock position, in which the release lever holds the locking lever in the engaging position, and an unlock position, in which the release lever moves the locking lever to the release position.

6. The apparatus according to claim 5, wherein:

the locking lever includes a locking recess configured to receive at least a portion of the flap and a release shoulder located below the locking recess; and the release lever has a tip configured to press the release shoulder.

7. The apparatus according to claim 2, wherein:

the flap includes a first flap portion and a second flap portion which is orthogonal to the first flap portion; and the first flap portion has a first free end configured to releasably engage with the locking lever.

8. The apparatus according to claim 7, wherein the flap further includes a first extension portion extending from the first flap portion, a second extension portion extending from the second flap portion, a first projection protruding from an end of the first extension portion, and a second projection protruding from an end of the second extension portion.

9. The apparatus according to claim 8, wherein the flap mechanism further includes a stopper having a recess in which one of the first projection and the second projection is releasably received.

10. The apparatus according to claim 9, wherein the stopper is configured to be mounted on the center rail.

11. The apparatus according to claim 1, wherein the flap mechanism includes a flap configured to be rotatably mounted on the center rail, and a driving motor configured to rotate the flap.

12. The apparatus according to claim 1, wherein the flap mechanism includes a flap configured to be linearly movable on the center rail, and a driving motor configured to drive the flap.

13. The apparatus according to claim 12, wherein:

the flap includes a first flap portion and a second flap portion pivotally connected to the first flap portion, and the first flap portion is configured to be rotatable by the driving motor.

14. The apparatus according to claim 12, wherein:

the flap includes a flap portion and a guide connected to the flap portion; and the guide is configured to be linearly movable by the driving motor.

15. The apparatus according to claim 14, wherein:

the guide has rack teeth; and a pinion meshed with the rack teeth is connected to the driving motor.

16. A vehicle comprising:

a vehicle body;

a vehicle door connected to the vehicle body;

a rail mounted on the vehicle body in a longitudinal direction of the vehicle body;

a roller unit mounted on the vehicle door, wherein the roller unit is configured to move along the rail, and to allow the vehicle door to open and close in both a sliding mode and a swing mode;

a center rail extending from a rear edge of a door aperture of the vehicle body;

a center roller unit configured to be guided along the center rail; and a flap mechanism configured to prevent the center roller unit from being separated from the center rail in the sliding mode, and configured to allow the center roller unit to be released from the center rail in the swing mode.

17. The vehicle according to claim 16, wherein the flap mechanism includes a flap rotatably mounted on the center rail, and a locking lever releasably engaged with the flap.

18. The vehicle according to claim 17, wherein:

the locking lever is configured to move between an engaging position, in which the locking lever is engaged with the flap, and a release position, in which the locking lever is released from the flap;

the locking lever is movable to the release position by a release lever; and the release lever is configured to move between a lock position, in which the release lever holds the locking lever in the engaging position, and an unlock position, in which the release lever moves the locking lever to the release position.

19. The vehicle according to claim 17, wherein:

the flap includes:

a first flap portion;

a second flap portion orthogonal to the first flap portion;

a first extension portion extending from the first flap portion;

a second extension portion extending from the second flap portion;

a first projection protruding from an end of the first extension portion; and a second projection protruding from an end of the second extension portion;

a stopper mounted on the center rail, the stopper having a recess in which one of the first projection and the second projection is releasably received; and the first flap portion has a first free end releasably engaged with the locking lever.

20. A vehicle comprising:

a vehicle body;

a vehicle door connected to the vehicle body;

a rail mounted on the vehicle body in a longitudinal direction of the vehicle body;

a roller unit mounted on the vehicle door, wherein the roller unit is configured to move along the rail, and to allow the vehicle door to open and close in both a sliding mode and a swing mode;

a center rail extending from a rear edge of a door aperture of the vehicle body;

a center roller unit configured to be guided along the center rail; and a flap mechanism configured to prevent the center roller unit from being separated from the center rail in the sliding mode, and configured to allow the center roller unit to be released from the center rail in the swing mode, the flap mechanism including:

a flap configured to be linearly movable on the center rail, the flap including a first flap portion and a second flap portion pivotally connected to the first flap portion; and a driving motor configured to drive the flap, wherein the first flap portion is configured to be rotatable by the driving motor.

* * * * *